US009719310B2

(12) United States Patent
MacGregor et al.

(10) Patent No.: US 9,719,310 B2
(45) Date of Patent: Aug. 1, 2017

(54) CONNECTOR ASSEMBLY FOR CONNECTING A HOSE TO A TUBULAR

(71) Applicant: MANAGED PRESSURE OPERATIONS PTE. LTD., Singapore (SG)

(72) Inventors: Alexander John MacGregor, Scotland (GB); Ted Jee Voon, Kuching (MY)

(73) Assignee: MANAGED PRESSURE OPERATIONS PTE. LTD., Singapore (SG)

( * ) Notice: Subject to any disclaimer, the term of this patent is extended or adjusted under 35 U.S.C. 154(b) by 0 days.

(21) Appl. No.: 15/105,571

(22) PCT Filed: Dec. 17, 2014

(86) PCT No.: PCT/GB2014/053743

§ 371 (c)(1),
(2) Date: Jun. 17, 2016

(87) PCT Pub. No.: WO2015/092403

PCT Pub. Date: Jun. 25, 2015

(65) Prior Publication Data

US 2016/0348449 A1 Dec. 1, 2016

(30) Foreign Application Priority Data

Dec. 18, 2013 (GB) ..... 1322434.0

(51) Int. Cl.
*E21B 17/01* (2006.01)
*E21B 17/02* (2006.01)
(Continued)

(52) U.S. Cl.
CPC ..... *E21B 17/02* (2013.01); *E21B 17/01* (2013.01); *E21B 17/015* (2013.01);
(Continued)

(58) Field of Classification Search
CPC ..... E21B 17/01; E21B 17/02; E21B 19/004; E21B 21/001; E21B 21/08; E21B 33/085
See application file for complete search history.

(56) References Cited

U.S. PATENT DOCUMENTS 4,626,135 A 12/1986 Roche
5,314,024 A * 5/1994 Rodgers ..... F16L 27/06 166/347

(Continued)

FOREIGN PATENT DOCUMENTS

GB 2486009 A 6/2012
GB 2504484 A 2/2014

(Continued)

*Primary Examiner* — Matthew R Buck
(74) *Attorney, Agent, or Firm* — Norman B. Thot

(57) ABSTRACT

A connector assembly for connecting a hose to a tubular element. The connector assembly includes a housing, a hose connector, and a latch. The housing encloses a main passage which is parallel to a longitudinal axis of the housing and which has a side passage extending through the housing from an exterior of the housing into the main passage. The side passage extends through a connector tube mounted on an exterior of the housing. A hose connector is secured to an end of the hose and engages with the connector tube to connect the hose to the tubular element. The hose connector comprises a pipe portion which mates with the connector tube to connect an interior of the hose to the side passage. The latch urges the connector tube and the pipe portion into engagement and prevents a separation thereof.

19 Claims, 20 Drawing Sheets

(51) Int. Cl.

| | |
|---|---|
| ***E21B 21/02*** | (2006.01) |
| ***E21B 19/00*** | (2006.01) |
| ***E21B 21/00*** | (2006.01) |
| ***E21B 21/08*** | (2006.01) |
| ***E21B 34/00*** | (2006.01) |
| *E21B 33/08* | (2006.01) |

(52) U.S. Cl.

CPC ..... *E21B 19/004* (2013.01); *E21B 21/001* (2013.01); *E21B 21/02* (2013.01); *E21B 21/08* (2013.01); *E21B 34/00* (2013.01); *E21B 33/085* (2013.01); *E21B 2034/002* (2013.01)

(56) References Cited

U.S. PATENT DOCUMENTS

| | | | | |
|---|---|---|---|---|
| 6,904,981 | B2 | 6/2005 | van Riet | |
| 6,913,092 | B2 | 7/2005 | Bourgoyne et al. | |
| 7,044,237 | B2 | 5/2006 | Leuchtenberg | |
| 9,109,420 | B2 * | 8/2015 | Tindle | E21B 33/035 |
| 9,428,975 | B2 * | 8/2016 | Stave | E21B 17/01 |
| 2005/0061546 | A1 | 3/2005 | Hannegan | |
| 2008/0105434 | A1 | 5/2008 | Orbell et al. | |
| 2010/0065277 | A1 | 3/2010 | Barratt | |
| 2010/0314123 | A1 | 12/2010 | Luppi | |
| 2011/0056701 | A1 * | 3/2011 | Jones | E21B 17/046 166/378 |
| 2011/0101682 | A1 * | 5/2011 | Vatne | E21B 17/01 285/308 |
| 2012/0141212 | A1 | 6/2012 | Long | |
| 2012/0325486 | A1 * | 12/2012 | Gilmore | E21B 19/006 166/345 |
| 2013/0014991 | A1 | 1/2013 | Leuchtenberg | |
| 2013/0092388 | A1 * | 4/2013 | Gilmore | E21B 17/01 166/367 |
| 2014/0138096 | A1 | 5/2014 | Leuchtenberg et al. | |
| 2016/0230480 | A1 * | 8/2016 | Jansen | E21B 19/002 |

FOREIGN PATENT DOCUMENTS

| | | | |
|---|---|---|---|
| GB | 2506291 | A | 3/2014 |
| WO | WO 2009/134138 | A1 | 11/2009 |
| WO | WO 2011/104279 | A2 | 9/2011 |
| WO | WO 2012/143723 | A2 | 10/2012 |

* cited by examiner

CONNECTOR ASSEMBLY FOR CONNECTING A HOSE TO A TUBULAR

CROSS REFERENCE TO PRIOR APPLICATIONS

This application is a U.S. National Phase application under 35 U.S.C. §371 of International Application No. PCT/GB2014/053743, filed on Dec. 17, 2014 and which claims benefit to Great Britain Patent Application No. 1322434.0, filed on Dec. 18, 2013. The International Application was published in English on Jun. 25, 2015 as WO 2015/092403 A2 under PCT Article 21(2).

FIELD

The present invention relates to a connector assembly for connecting a hose to a tubular, particularly, but not exclusively, for connecting a flexible rubber hose to a flow spool provided in a drilling riser.

BACKGROUND

During drilling of an underwater wellbore, a riser is provided to return the drilling fluid (mud), cuttings and any other solids or fluids from the wellbore to the surface. The drill string extends down the center of the riser, and the returning drilling fluid, cuttings etc. flow along the annular space in the riser around the drill string (the riser annulus).

When drilling of the wellbore is carried out using a floating rig such as a drill ship, a semi-submersible, floating drilling or production platform, it is known to provide the riser with a slip joint which allows the riser to lengthen and shorten as the rig moves up and down as the sea level rises and falls with the tides and the waves. A ball joint (or flex-joint) is also provided to accommodate angular displacement of the riser from the vertical. The returning drilling fluid leaves the riser via a diverter which is mounted above the slip joint.

Such a slip joint is, for example, described in U.S. Pat. No. 4,626,135, and comprises an outer tube section which is connected to the wellhead, and an inner tube section which sits within the outer tube section and which is connected to the rig floor. Seals are provided between the outer and inner tube sections, and these substantially prevent leakage of fluid from the riser whilst allowing the inner tube section to slide relative to the outer tube section.

This system also includes an annular blow out preventer which is located below the slip joint, and which is used as a gas handler to divert the flow of gas from a well control incident. An auxiliary choke line extends from the riser below the point at which the riser annulus is closed by the blowout preventer, and, in the event of such an incident, the blow out preventer is closed, and a valve in an auxiliary choke line opened, so that the formation gas may be circulated out via the auxiliary choke line.

Drilling methods, such as managed pressure drilling (MPD) or mud cap drilling, which involve the pressurization of fluid in the wellbore annulus are becoming increasingly important, and these require the ability to contain fluid pressure in the riser annulus during drilling. Examples of these type of systems are disclosed in U.S. Pat. No. 6,904,981 and U.S. Pat. No. 7,044,237.

In floating drilling rigs, wave motion means that the seals between the outer and inner tube sections of the slip joint are subjected to significant movement, and, as a result the pressure sealing capacity of the seals in conventional slip joint designs is limited. As a result, it is not possible to use the conventional marine riser drilling system described above for MPD.

To address this issue, an alternative system is presented in US2005/0061546 and U.S. Pat. No. 6,913,092, in which a "rotating control head" including rotating blow out preventer (RBOP) or rotating control device (RCD) mounted above the slip joint. Connectors for diverting fluid from the riser are provided on the RCH housing below the RCD/RBOP. When used for MPD, the slip joint is locked to eliminate movement across the slip joint seal, the RCD or RBOP is closed, and fluid returns are directed to the rig's systems (separators, shakers etc.) via hoses connected to the connectors.

A further alternative system is disclosed in WO2011/104279. In this system, the returning drilling fluid exits the riser via a flow spool which is mounted below the RCD and above the slip joint. In this case, a high pressure slip joint is required—an example of a suitable design is disclosed in WO2012/143723.

It is also known to avoid subjecting the flow spool to high pressures during MPD by mounting the RCD/RBOP below the slip joint. Such an alternative system for providing pressurized riser assembly is disclosed in US 2008/0105434. In this system, a universal riser section (OURS) is placed in the riser below the slip joint. The OURS includes, amongst other things, at least one rotating control device (RCD), together with all the usual connections and attachments required to operate the RCD, and at least one outlet for the fluid returns.

It is also known to replace a conventional slip-joint system with a specialized rotating control head system which includes one or more long "flow crosses"—conduits which extend horizontally from the riser, a flow spool or the rotating control device (RCD) housing. Valving and flexible hoses hang from each of the flow crosses, and the mud is returned from the riser annulus via the flow crosses and hoses.

Where fluid lines are connected to riser below the slip joint, the flexibility of the hoses accommodates the heave of the rig floor relative to the riser.

SUMMARY

The present invention relates to an improved connector assembly for connecting hoses to a drilling riser, via a flow spool or the like, as is required in the systems mentioned above.

In an embodiment, the present invention provides a connector assembly for connecting a hose to a tubular element. The connector assembly includes a tubular housing, a hose connector, and a latch. The tubular housing encloses a main passage extending substantially parallel to a longitudinal axis of the tubular housing and which is provided with a side passage extending through the tubular housing from an exterior of the tubular housing into the main passage. The side passage further extends through a connector tube which is mounted on an exterior of the tubular housing. A hose connector is configured to be secured to an end of the hose and to engage with the connector tube for connecting the hose to the tubular element. The hose connector comprises a pipe portion which is configured to mate with the connector tube so that an interior of the hose is connected to the side passage. The latch is operable to urge the connector tube and the pipe portion into engagement and to prevent a separation of the connector tube and the pipe portion when the connector tube and the pipe portion are mated to connect the interior of the hose with the side passage.

BRIEF DESCRIPTION OF THE DRAWINGS

The present invention is described in greater detail below on the basis of embodiments and of the drawings in which.

DETAILED DESCRIPTION

Figure 1:
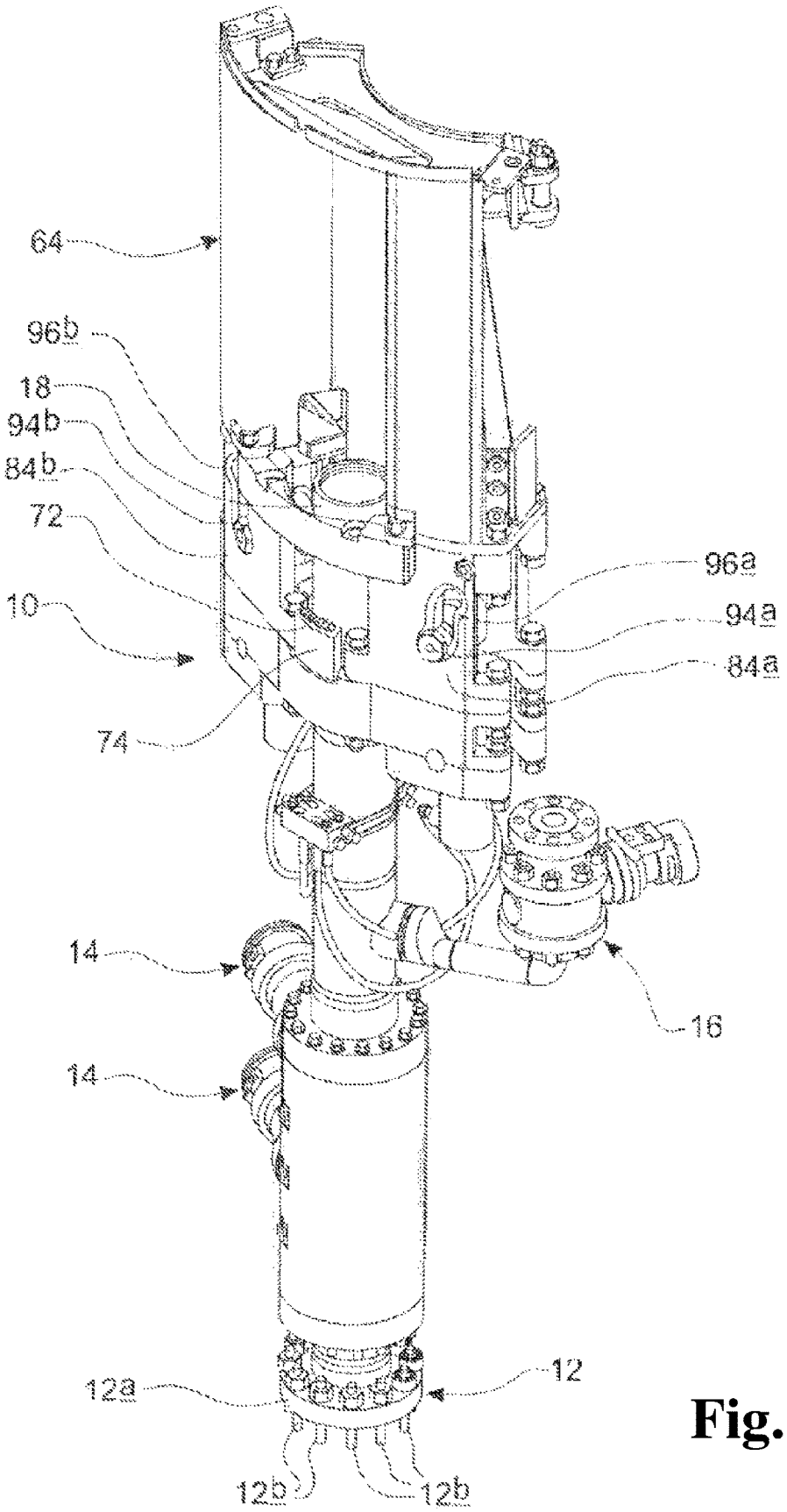
FIG. 1 shows a first perspective view of a hose connector according to third aspect of the invention.

According to a first aspect of the invention we provide a connector assembly for connecting a hose to a tubular element, the connector assembly comprising a tubular housing which encloses a main passage extending generally parallel to a longitudinal axis of the housing and which is provided with a side passage extending through the housing from the exterior of the housing into the main passage, the side passage further extending through a connector tube which is mounted on the exterior of the housing, the connector further being provided with a hose connector adapted to be secured to an end of the hose and to engage with the connector tube for connecting the hose to the tubular element, the hose connector comprising a pipe portion which is adapted to mate with the connector tube so that the interior of the hose is connected to the side passage, wherein the assembly is further provided with a latch which is operable to urge the connector tube and pipe portion into engagement and to prevent separation of the connector tube and pipe portion when the two are mated to connect the interior of the hose with the side passage.

The latch may be hydraulically operated.

The latch may be movable between an open position in which the connector tube and pipe portion may be separated, and a closed position in which it prevents separation of the connector tube and pipe portion, and configured such that, on movement of the latch from the closed position to the open position, the latch pushes the connector tube and pipe portion apart.

Advantageously the pipe portion is adapted to be placed over the connector tube so that the connector tube extends into the pipe portion when the two parts mate to connect the interior of the hose with the side passage.

In this case, the pipe portion is provided with a radially outwardly extending flange at its free end, and the latch is provided with a lowermost catch part and an uppermost catch part and is configured such that when the latch is in the closed position the uppermost catch part bears down on the flange thus preventing the pipe portion of being lifted off the connector tube, and as the latch is moved to the open position, the lowermost catch part pushes the flange up to commence lifting the pipe portion off the connector tube.

According to a second aspect of the invention we provide a connector for connecting a hose to a tubular element, the connector comprising two generally parallel pipe portions connected by a intermediate pipe portion, the connector being provided with a mounting part on which is located a first suspension part and a second suspension part to each of which a flexible elongate element such as a wire, chain or rope may, in use, be secured for lowering the connector into engagement with the tubular element, the two suspension parts being spaced relative to one another, wherein one or both of the suspension parts is movable relative to the mounting part so that the separation of the suspension parts generally perpendicular to the two generally parallel pipe portions may be varied.

In one embodiment, only one of the suspension parts is movable relative to the mounting part so that the separation of the suspension parts generally perpendicular to the two generally parallel pipe portions may be varied.

In one embodiment, the intermediate portion is curved. In this case, the intermediate portion may be generally semi-circular.

One or both of the suspension parts may comprise a loop which is pivotally mounted on the mounting part of the connector.

The or each movable suspension part may be mounted on a slider which can slide along a slot provided in the mounting part, each suspension part also including a fastener which is operable to releasably lock the slider in a desired location relative to the slot.

The or each movable suspension part may be provided with a ratchet mechanism which is operable to assist in retaining the or each suspension part in the desired position relative to the mounting part.

According to a third aspect of the invention we provide a drilling riser and hose assembly, the hose being connected to the riser using a connector according to the first aspect of the invention.

The tubular element may be part of a flow spool mounted on the riser.

According to a fourth aspect of the invention we provide a connector assembly for connecting a hose to a tubular element, the connector assembly comprising a tubular housing which encloses a main passage extending generally parallel to a longitudinal axis of the housing and which is provided with a side passage extending through the housing from the exterior of the housing into the main passage, the side passage further extending through a connector tube which is mounted on the exterior of the housing, wherein the connector assembly is further provided with an alignment structure which has a top part which extends radially outwardly relative to the tubular housing above a free end of the connector tube so that the longitudinal axis of the connector tube passes through the top part of the alignment structure.

In one embodiment the connector tube is mounted on the exterior of the housing such that a longitudinal axis of the connector tube is generally parallel to the longitudinal axis of the housing.

In one embodiment, the connector tube extends from a first end of the housing and the top part of the alignment structure extends from the housing between the connector tube and a second end of the housing.

The top part of the alignment structure may be inclined relative to the housing such that the portion closest to the housing is nearest to the connector tube, and the portion furthest from the housing is further away from the connector tube.

The alignment structure may further include two side parts which extend generally parallel to the longitudinal axis of the connector tube and which are arranged either side of the connector tube so that at least part of the connector tube is located between the two side parts.

In one embodiment, the connector assembly further comprises a hose connector adapted to be secured to an end of the hose and engaged with the connector tube for connecting the hose to the tubular element, the hose connector comprising two generally parallel pipe portions connected by a intermediate pipe portion, the connector being provided with a mounting part on which is located at least one suspension part to which a wire may, in use, be secured for lowering the hose connector into engagement with the connector tube, the space between the top part of the alignment structure and the connector tube being greater than the length of the hose connector generally parallel to the two generally parallel pipe portions.

The hose connector may have any of the features of the connector according to the first aspect of the invention.

The tubular housing may be configured to be mounted on a drilling riser.

According to a fifth aspect of the invention we provide a connector assembly for connecting a hose to a tubular element, the connector assembly comprising a tubular housing which encloses a main passage extending generally parallel to a longitudinal axis of the housing and which is provided with a side passage extending through the housing from the exterior of the housing into the main passage, the side passage further extending through a connector tube which is mounted on the exterior of the housing, the connector further being provided with a hose connector adapted to be secured to an end of the hose and to engage with the connector tube for connecting the hose to the tubular element, the hose connector comprising a pipe portion which is adapted to mate with the connector tube so that the interior of the hose is connected to the side passage, wherein the connector tube and pipe portion of the hose connector are both circular in transverse cross-section and are both provided with a plurality of teeth which may be engaged to assist in retaining the connector tube and pipe portion in a desired angular orientation relative to one another.

Advantageously one of the connector tube and the pipe portion is adapted to extend into the other of the pipe portion or connector tube when the two parts mate to connect the interior of the hose with the side passage. In one embodiment, the pipe portion is adapted to be placed over the connector tube so that the connector tube extends into the pipe portion when the two parts mate to connect the interior of the hose with the side passage.

In this case, the one of the connector tube or pipe portion which is located outside the other when the two mate to connect the interior of the hose with the side passage may be provided with a radially outwardly extending flange at its free end, the teeth being provided in a surface of the flange which, in use, extends perpendicular to the longitudinal axis of the connector tube.

The assembly may further be provided with a latch which is operable to urge the teeth of the connector tube and pipe portion into engagement and to prevent separation of the connector tube and pipe portion when the two are mated to connect the interior of the hose with the side passage.

The latch may be hydraulically operated.

The latch may be movable between an open position in which the connector tube and pipe portion may be separated, and a closed position in which it prevents separation of the connector tube and pipe portion, and configured such that, on movement of the latch from the closed position to the open position, the latch pushes the connector tube and pipe portion apart.

The tubular housing may be adapted to be secured to a drilling riser.

According to a sixth aspect of the invention we provide a riser flow diversion assembly having a main passage, a side port connecting the main passage with the exterior of the flow spool, and mounting parts suitable for mounting the assembly on a riser so that the main passage forms a continuous passage with the riser, the assembly further including a hose connector assembly comprising a connector tube through which the side passage extends, and which is mounted on the exterior of the housing such that the a longitudinal axis of the connector tube is generally parallel to the main passage.

The riser flow diversion assembly may be provided with a plurality of side ports, each of which has an associated hose connector assembly. In this case, the hose connectors may be spaced around the circumference of the flow spool in a substantially regular array.

Advantageously, the outer diameter of the flow spool and associated hose connector(s) does not exceed 46.5 inches.

The hose connector assembly of the riser flow diversion assembly may have any feature or any combination of features of the connector assembly according to the third, fourth or fifth aspect of the invention.

An embodiment of the invention will now be described, by way of example only, with reference to the following figures.

Figure 2:
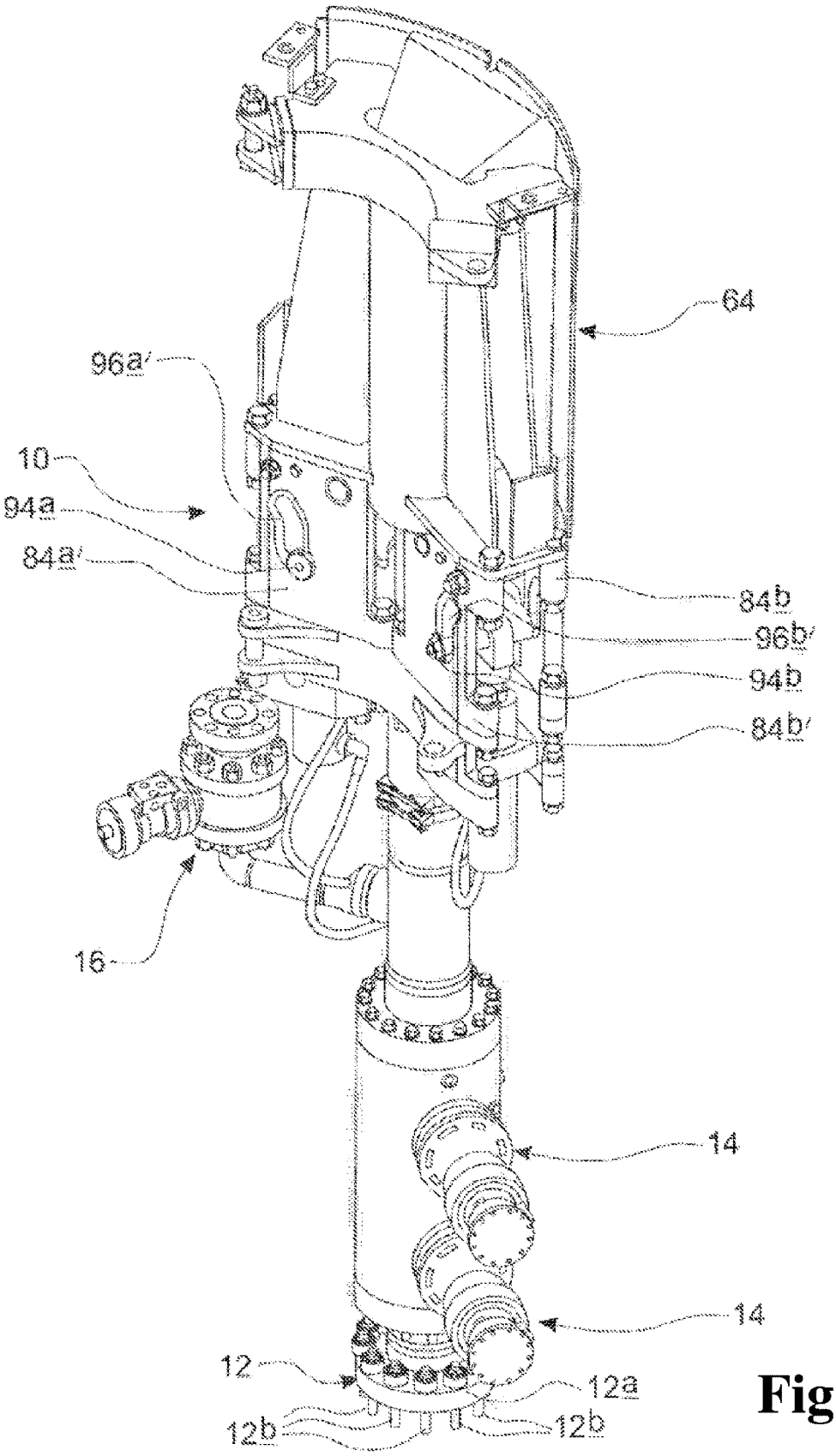
FIG. 2 shows a second perspective view of the hose connector shown in FIG. 1.
Figure 2A:
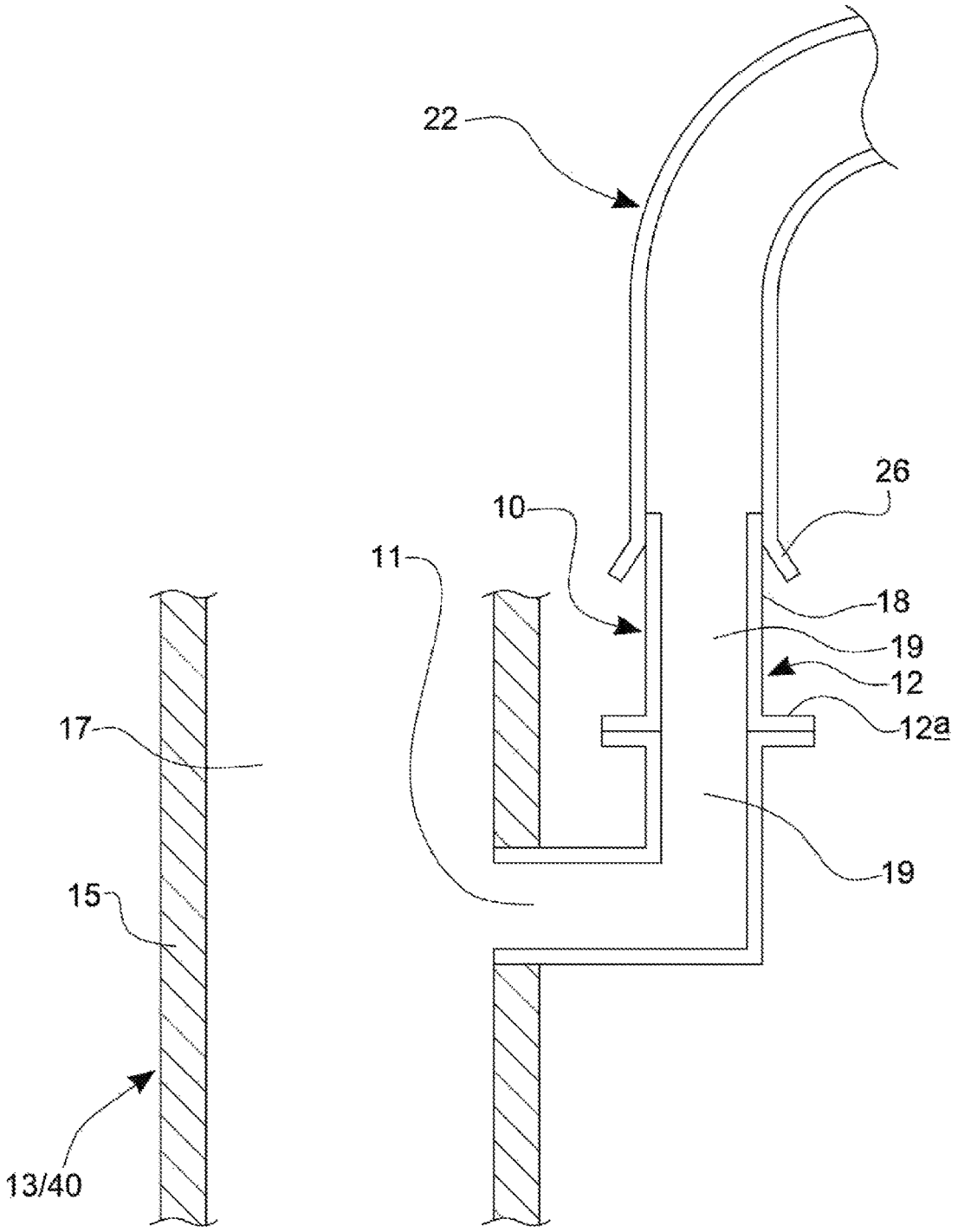
FIG. 2*a* shows a cross-sectional view of a hose and gooseneck assembly.

Referring now to FIGS. 1, 2 and 2*a*, there is shown a hose coupling assembly10 comprising a side port connector 12 for connection to a side port 11 in a drilling riser 13, two side port isolation valves 14, a trapped gas displacement valve 16, and hose connector tube 18. The side port 11 is provided in a tubular housing 15 of the drilling riser 13, the tubular housing 15 enclosing a main passage 17. The side port 11 thus connects the main passage 17 with the exterior of the drilling riser 13. The hose coupling assembly 10 has a flow passage 19 which extends from the side port 11 along the hose connector tube 18 of the side port connector 12. The hose connector tube 18 has a longitudinal axis which, in use, typically extends generally vertically.

The side port connector 12 is, in use, secured to the drilling riser 13 so that the flow passage 19 in the hose coupling assembly 10 forms a continuous passage with a side passage 11 in the drilling riser 13. In this example, this is achieved by means of a flange 12*a* and a plurality of bolts 12*b* extending through apertures in the flange 12*a*. These bolts may be used to fasten the hose coupling assembly 10 to a corresponding flange provided around the side port 11 in the drilling riser 13.

Figure 5:
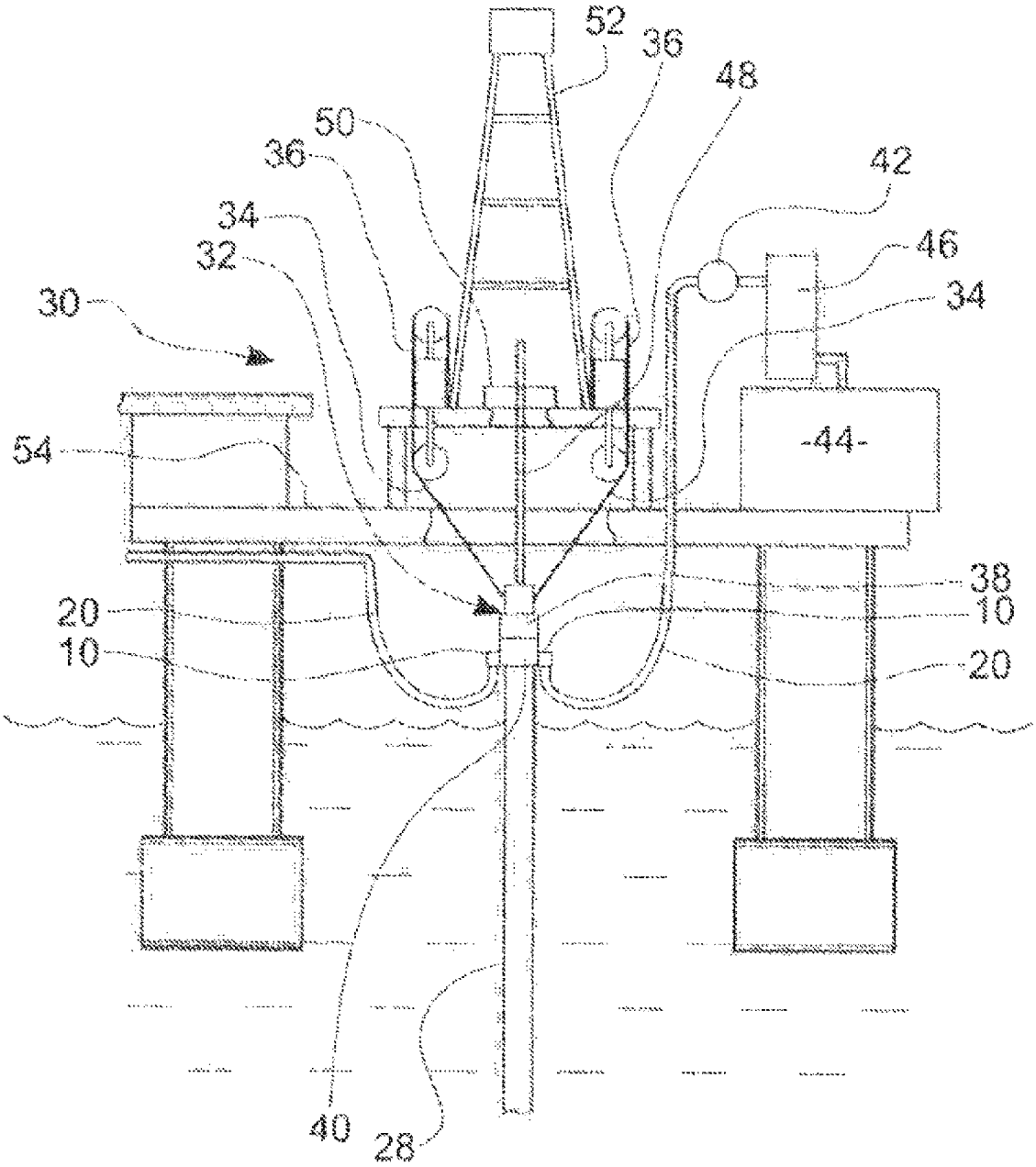
FIG. 5 shows a schematic illustration of an offshore drilling rig including a hose, gooseneck assembly and hose connector.

Advantageously, the side port 11 is provided in a flow diversion assembly such as a flow spool 40, which is mounted on a riser 28, as shown in FIG. 5. The flow spool 40 has a tubular housing 15 which encloses a main passage 17 which forms a continuous passage with the drilling riser 13, the side port 11 connecting the main passage 17 with the exterior of the flow spool 40. The hose coupling assembly 10 is preferably arranged so that the longitudinal axis of the hose connector tube 18 extends generally parallel to the main passage of the flow spool 40. The flow spool 40 may be provided with a plurality of side ports, each of which has an associated hose coupling assembly 10. In this case, the hose coupling assemblies 10 are preferably spaced around the circumference of the flow spool 40 in a substantially regular array.

In one embodiment of the invention, the outer diameter of the flow spool 40 and associated hose coupling assembly/assemblies 10 does not exceed 46.5 inches. This maximum outer diameter of 46.5 inches leaves minimal design space to work with for the flow spool 40 and gooseneck design, given the minimum required inner diameter (ID) of the flow spool's main bore and the minimum ID that is required for the flow line bores within the spool, which ultimately dictates the OD of the flow spool. The minimum ID design of the flow line bores, which form the continuous passageways when connected to the gooseneck assembly mitigate erosion within the flow spool's flow lines over a range of predicted fluid flow and solids rates through the lines. The compactness of the design, means that the flow spool 40 and associated hose coupling assemblies 10 can be drifted through the rotary table for its installation, using the rig's hoisting system and completing the connection into the riser on the rig floor utilizing the rig spider to suspend it in the rotary table. This reduces the installation and removal complexities of the flowspool substantially, resulting in a safer, more time efficient installation/removal sequence into/out of the riser. Exceeding this envelope requires the flow spool to be installed through the moonpool area, which becomes complex and riskier with cranes and tugger lines, and personnel suspended above the open water.

The side port isolation valves 14 are operable to close the main flow passage 19 in the hose coupling assembly 10, thus substantially preventing flow of fluid from or into the riser via the side port. These are of conventional construction, and may be ball valves, for example.

The trapped gas displacement valve 16 is used to create a flow path to displace trapped gas between the gooseneck connection and the base of the blowout preventer. The valve rejoins the flow line and flows the gas to the choke manifold or RGH manifold. This valve 16 is opened only after the side port valves 14 are closed in order to bleed the trapped pressure or displace the trapped gas.

Figure 3:
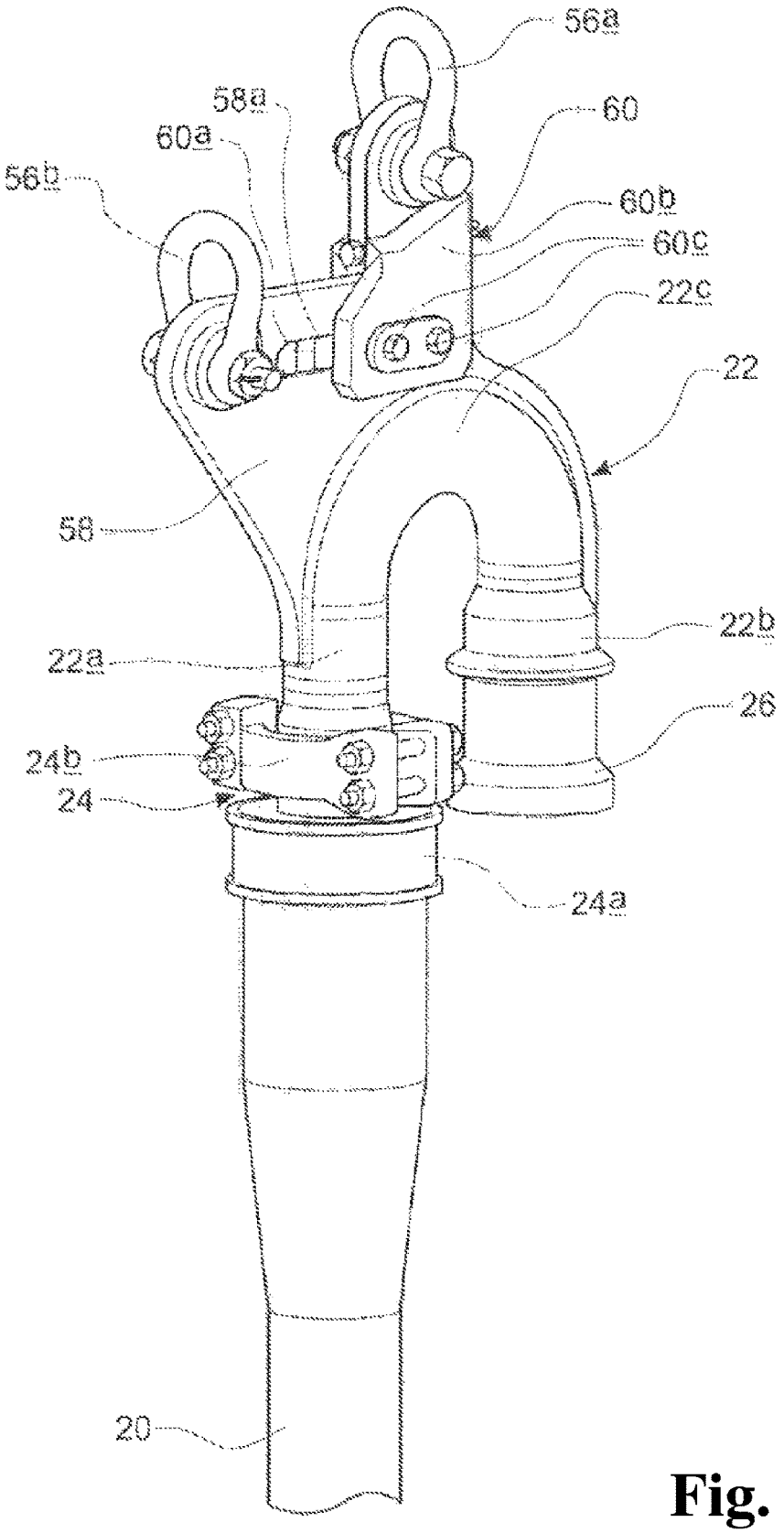
FIG. 3 shows a perspective view of a hose and gooseneck assembly for use in connection with the hose connector illustrated in FIGS. 1 and 2, and according to the second aspect of the invention.

Referring now to FIG. 3, there is shown an end of a hose 20, with a hose connector 22 mounted thereon. In this example, the hose connector 22 is a gooseneck connector 22 which comprises a tube having a first portion 22*a* which is connected to the hose 20, and a second portion 22*b* which is adapted to be engaged with the hose connector tube 18 of the hose coupling assembly 10. The first portion 22*a* and the second portion 22*b* of the gooseneck connector 22 are generally parallel and are joined by a generally semicircular intermediate portion 22*c*. The gooseneck connector 22 thus forms a generally U-shaped passage which, when the second portion 22*b* is connected to the hose coupling assembly 10 forms a continuous passage connecting the flow passage 19 of the hose coupling assembly 10 with the interior of the hose 20.

The hose 20 is secured to the first portion 22*a* of the gooseneck connector 22 by means of a conventional hose clamp and seal arrangement 24. A Techlok clamp connector 24*b* made by the Vector Technology Group may be used, for example. During installation, the connection between the hose 20 and the gooseneck connector 22 is made up on surface, on the rig floor.

Figure 4:
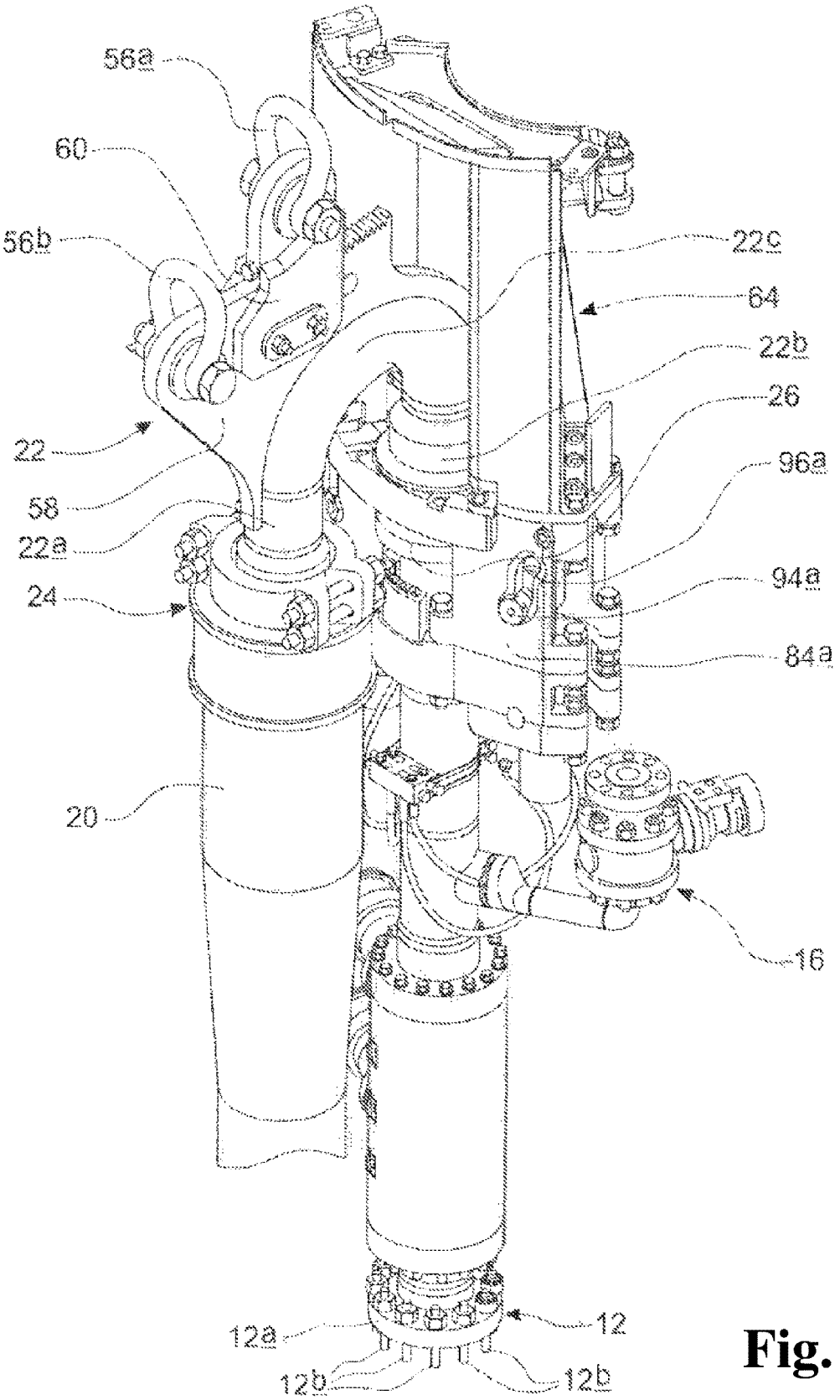
FIG. 4 shows a perspective view of the hose and gooseneck assembly shown in FIG. 3 mounted on the hose connector shown in FIGS. 1 and 2.

In this example, when the gooseneck connector 22 is mounted on the hose coupling assembly 10, the hose connector tube 18 is located within the second portion 22*b* of the gooseneck connector 22. This is illustrated in FIG. 4. In other words, in the connection between the gooseneck connector 22 and the hose coupling assembly 10, the second portion 22*b* of the gooseneck connector 22 forms the female part, whilst the hose connector tube 18 forms the male part. This may be reversed, however. Appropriate, and conventional, seals are provided to ensure a substantially fluid tight seal between the hose connector tube 18 and the gooseneck connector 22.

The second portion 22*b* of the gooseneck connector 22 is provided with a locking flange 26 which extends radially outwardly thereof. In this embodiment, the locking flange 26 extends from the very end of the second portion 22*b*.

An example of an offshore drilling rig in which hoses 20 are connected to a drilling riser 28 is illustrated in FIG. 5. This figure shows a floating drilling rig 30 suitable for use in oil/gas drilling and production. The riser 28 extends up from a wellhead (not shown) mounted at the top of the well bore (not shown). The top end of the riser 28 is provided with a slip joint 32, having an outer barrel and an inner barrel, the inner barrel being suspended from the rig floor by wire cables 34 and tensioners 36. In this example, the rig is to be used in managed pressure drilling (MPD) and so a rotating pressure containment apparatus 38 such as a rotating control device (RCD) or rotating BOP (RBOP) is provided in the riser 28 below the slip joint 32. The rotating pressure containment apparatus 38 allows pressure in the wellbore to be controlled by closing the top of the riser 28.

The hoses 20 are connected to the riser 28 below the rotating pressure containment apparatus 38, in this example via a flow spool 40.

In this example, the hoses 20 are high flow rate large bore API hoses, and provide a return line for returning the drilling fluid (mud), cuttings and any other solids or fluids from the wellbore to the surface. The return line extends from the flow spool 40 to a choke manifold 42, from which the returning fluid is diverted to the rig's mud pit 44 via conventional separator systems 46 (mud gas separator, shaker table etc.).

In one embodiment, the flow spool 40 is provided with three side ports, each of which is connected to the surface by a separate hose 20 and hose coupling assembly 10. The three hose coupling assemblies 10 are spaced around the circumference of the flow spool 40, with the longitudinal axis of the main passage of the hose coupling assembly 10 extending generally parallel to the longitudinal axis of the riser 28. The three hose coupling assemblies 10 are advantageously positioned at generally the same height on the flow spool 40.

In normal use, two of these may serve to return drilling fluid to the mud pits 44, as described above, whilst the third is controlled by two programmable pressure-relief valves that will discharge returns to a diverter if pressure levels in the riser 40 reach dangerous levels. It will be appreciated that the number and size of the hoses 20 may be varied to provide increased redundancy or varying peak flow rate capacity, depending on the requirements of a particular drilling operation. It should also be appreciated that one of more of the hoses 20 could serve as injection points to pump fluid down the annulus whilst conducting pressurized mud-cap drilling, for example.

During drilling, a drill string 48 extends down into the riser 28 from a rotary table 50 mounted on the rig floor 54. Derrick 52 is provided to lower the drill string 48 into the riser 28.

During installation, the flow spool 40 and rotating pressure containment apparatus 38 are mounted on top of the riser 28. The hydraulic connections to the side ports in the flow spool 40 are then made by lowering the end of each hose 20 with the gooseneck connector 22 mounted thereon, onto one of the hose coupling assemblies 10. The attachments provided on the gooseneck connector 22 to facilitate this will now be described with reference to FIGS. 3 and 6.

Figure 6:
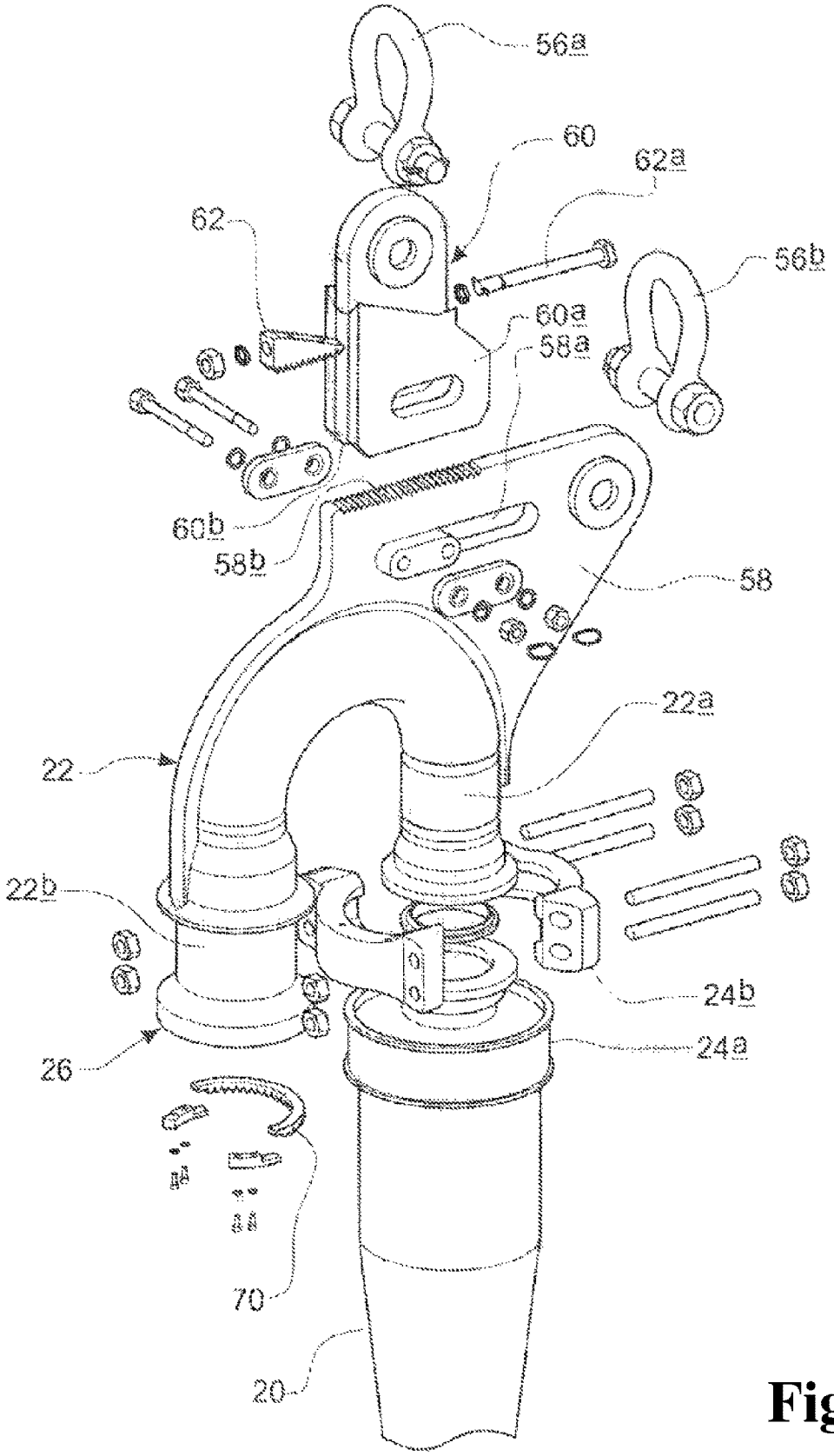
FIG. 6 shows an exploded illustration of the hose and gooseneck assembly shown in FIG. 3.

As illustrated in FIGS. 3 and 6, the gooseneck connector 22 is provided with two suspension parts 56*a*, 56*b*, to which wires may be secured, and the wires used to lower the hose 20 and gooseneck connector 22 onto the hose coupling assembly 10 on the flow spool 40. During this process, the gooseneck connector 22 is arranged with the open end of the second portion 22*b* pointing downwards. In this embodiment, the hose coupling assembly 10 is arranged on the flow spool 40 so that the hose connector tube 18 extends generally vertically upwardly. By providing two suspension parts 56*a*, 56*b*, the gooseneck connector 22 can be suspended by two separate wires, and the relative lengths of these can be altered to ensure that the first and second portions 22*a*, 22*b* of the gooseneck connector 22 are aligned generally parallel to the longitudinal axis of the hose connector tube 18, in this embodiment, generally vertically. This ensures that gooseneck 22 is correctly aligned to be lowered over the hose connector tube 18. This process may be assisted by configuring the gooseneck 22 so that the relative positions of the suspension parts 56*a*, 56*b* can be altered.

In this example the suspension parts 56*a*, 56*b* are loops which will hereinafter be referred to as padeyes. The padeyes 56*a*, 56*b* are secured to a mounting part 58 which extends from the intermediate portion 22*c* of the gooseneck connector 22, so that each can pivot relative to the mounting part 58. In this example, the padeyes are secured using bolts, but it will be appreciated that other fasteners may equally be used. In this example the first padeye 56*a* is bolted onto a carrier 60 which is movable relative to the mounting part 58, whilst the position of second padeye 56*b* is fixed. It should be appreciated, however, that both padeyes 56*a*, 56*b* could be mounted in such a way as to be capable of translational movement relative to the mounting part 58.

Figures 7A, 7B, 7C:
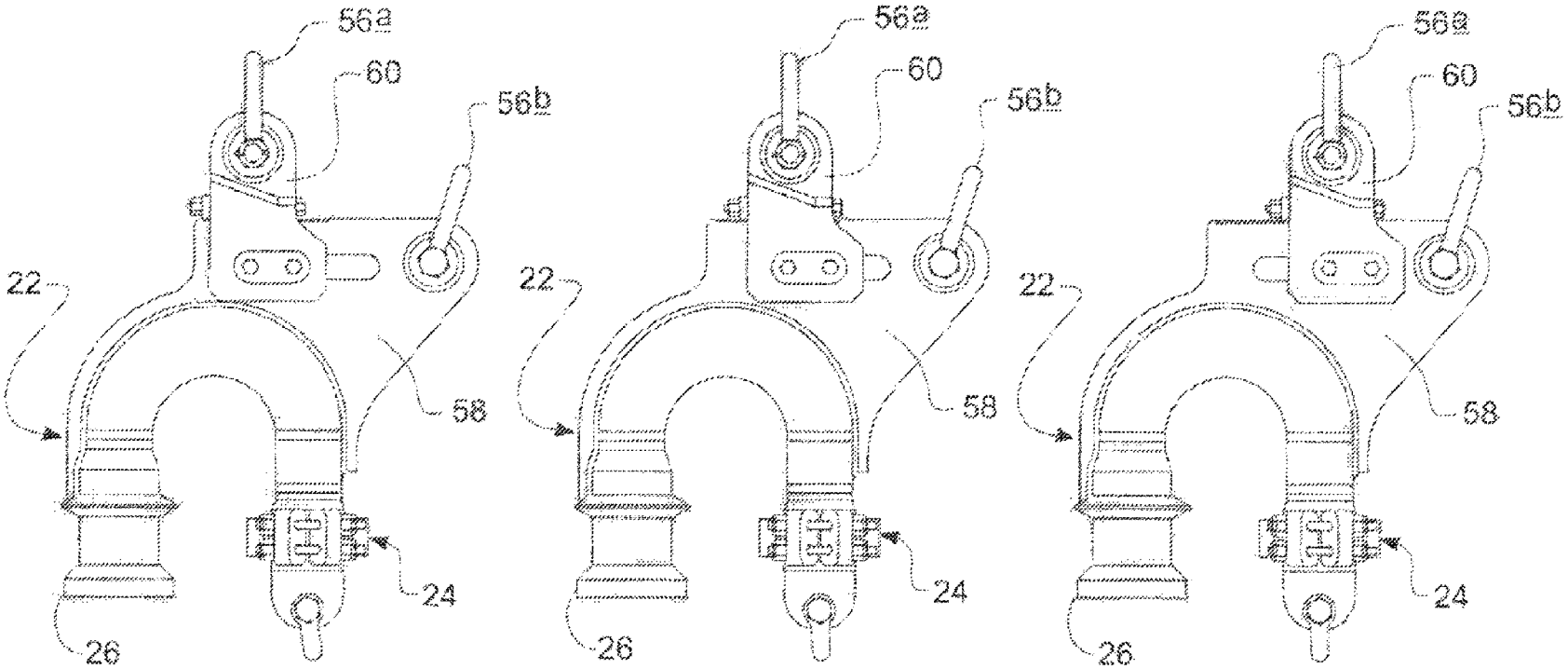
FIGS. 7*a*, 7*b* and 7*c* show the gooseneck assembly of FIGS. 3 and 6 with the adjustable support part in a a) first position, b) second, intermediate, position, and c) third position.

In this embodiment, the carrier 60 has two generally parallel legs 60*a*, 60*b* which are arranged on either side of the mounting part 58. These legs 60*a*, 60*b* and the mounting part 58 are each provided with a slot 58*a*, and the carrier 60 is secured to the mounting part 58 by means of a fastener 60*c* (two nut and bolt assemblies in this example) which extend through these slots. The carrier 60 may therefore slide along the mounting part 58, from one end of the slot 58*a* to the other, and may be fixed in the desired position by tightening the fasteners 60*c*. Three of the possible positions of the first padeye 56*a* are illustrated in FIGS. 7*a*, 7*b* and 7*c*. As can be seen, in FIG. 7*c*, the first padeye 56*a* is as close to the second padeye 56*b* as is possible, in FIG. 7*a*, the first padeye 56*a* is as far from the second padeye 56*b* as is possible, whilst in FIG. 7*b*, the first padeye 56*a* is in an intermediate position.

Although the force of the fasteners may be enough to retain the carrier 60 in the desired position, but, in this example, to assist in this, the carrier 60 and mounting part 58 are provided with a ratchet mechanism comprising a toothed edge 58*b* of the mounting part 58, and a toothed wedge 62. The toothed wedge 62 is located between the legs 60*a*, 60*b* of the carrier, and secured by means of a bolt 62*a* so that its teeth engage with the teeth of the toothed edge 58*b* of the mounting part 58.

Figure 9:
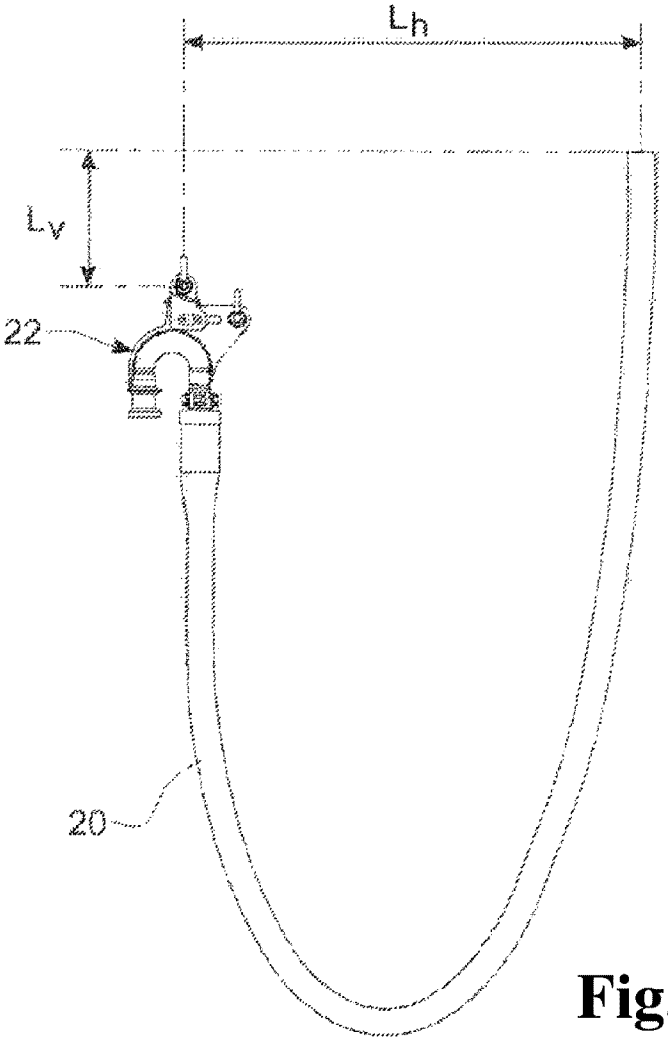
FIG. 9 is an illustration of a hose and gooseneck assembly of FIGS. 3 and 6 with the distance between the fixed point from which the hose hangs and the gooseneck connector labelled $L_h$ (horizontal separation) and $L_v$ (vertical separation)
Figure 8:
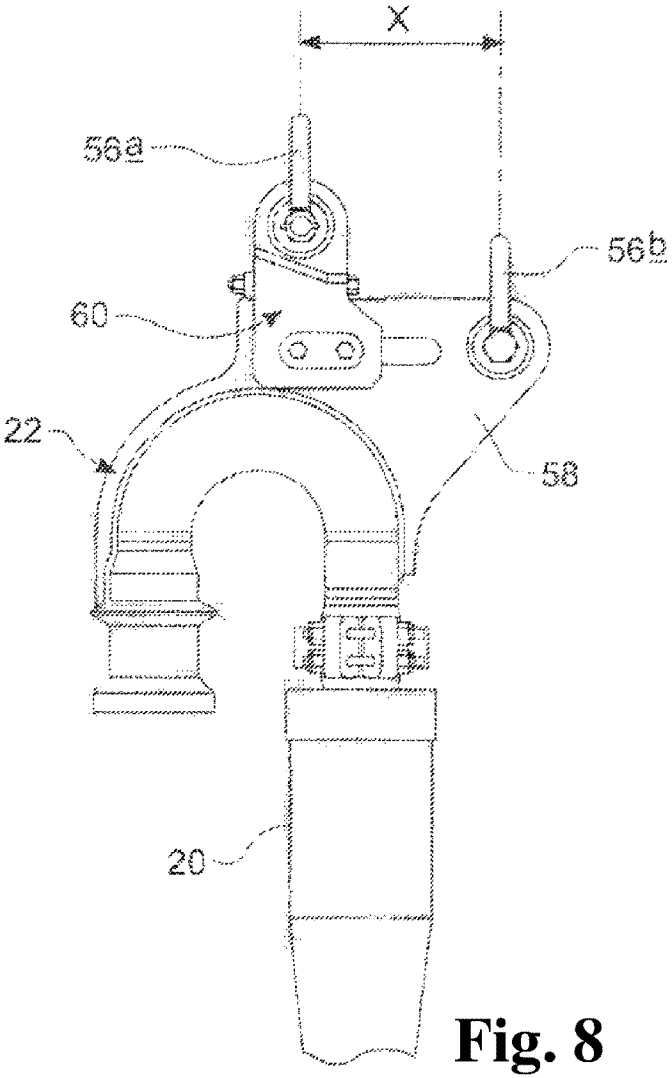
FIG. 8 is a further illustration of the gooseneck assembly of FIGS. 3 and 6 with the separation of the support parts labeled X.

As mentioned above, the facility for altering the separation of the two padeyes 56*a*, 56*b* can be useful in assisting an operator in maintaining the gooseneck connector 22 in the desired orientation parallel to the longitudinal axis of the hose connector tube 18, whilst mating the second portion 22*b* with the hose connector tube 18. Referring to FIG. 8 and FIG. 9, the ideal location of the pad eye lifting point is a function of the length of the hose (HL), the vertical separation between the point of connection of the hose in the rig moon pool area and the hose connector tube 18 on the flow spool ($L_v$), and the horizontal separation between the first padeye 56*a* and the point of connection of the hose ($L_h$) Decreasing or increasing the hose length HL and/or moving the connection point of the hose relative to the hose connector tube 18 creates a greater or lesser angle between the female end of the gooseneck connector 22 and the vertical axis, when the gooseneck connector 22 is in position to the lowered onto the hose connector tube 18.

Figure 10:
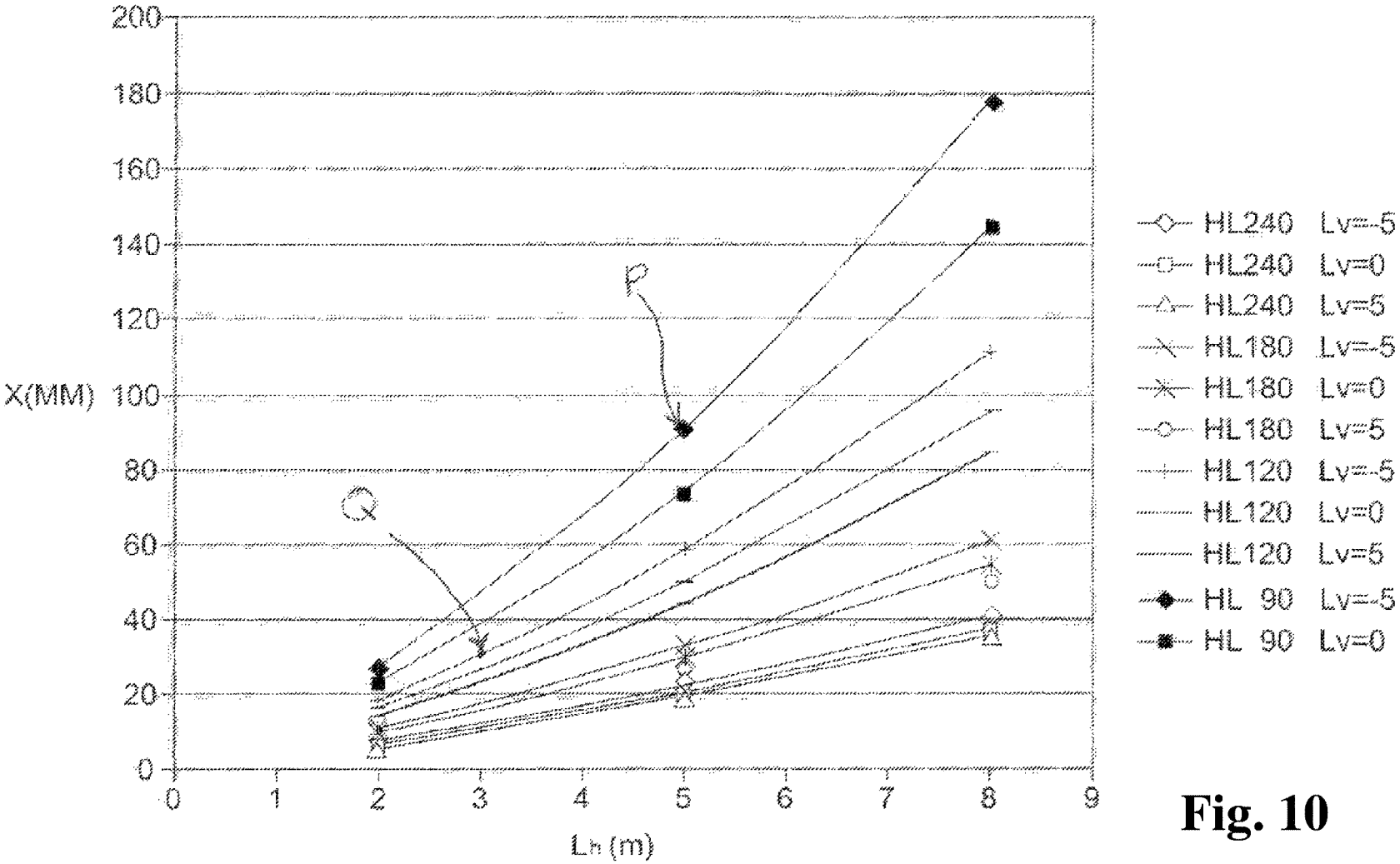
FIG. 10 is a graph of X against $L_h$ for a range of values of $L_v$ and for various lengths of hose.

Referring now to FIG. 10, this shows the relationship between the separation of the padeyes 56*a*, 56*b* (shown as X in FIG. 8) required for the gooseneck connector 22 to hang vertically from the first padeye 56*a* when the gooseneck connector 22 has reached the hose connector tube 18, and the horizontal separation of a fixed end of the hose 20 and first suspension part 56*a* (shown as $L_h$ in FIG. 9) for various values of vertical separation of the fixed end of the hose 20 and the first suspension part 56*a* (shown as $L_v$ in FIG. 9), and for various hose lengths (HL). For example, for a 90 foot long hose 20, if, when the gooseneck connector 22 is mounted on the hose connector tube 18, the horizontal separation of the fixed end of the hose 20 and the first padeye 56*a* will be 5 meters ($L_h$=5), and the first suspension part

56*a* is located 5 meters below the fixed end of the hose 20 ($L_v$=−5), the separation of the first suspension part 56*a* and second suspension part 56*b* should be set to 90 mm (point P on FIG. 10). Alternatively, for a 120 foot hose, when the first padeye 56*a* is aligned horizontally with the fixed point of the hose 20 ($L_v$=0), and $L_h$ is 3 m, the padeye separation X should be set to around 30 mm (point Q on FIG. 10).

The wire attached to the second padeye 56*b* could, of course, be used to alter the orientation of the gooseneck connector 22, by pulling upwardly on this wire to counteract any clockwise (as shown in FIGS. 7*a*, 7*b*, & 7*c*, 8 and 9) rotation of the gooseneck connector 22 caused by the weight of hose 20. The hose 20 and gooseneck connector 22 are a significant weight together, however, and it is preferable to avoid, or minimise, the need to use to this wire to rotate the gooseneck connector 22 by setting the padeye separation X to the correct value.

The movement of the "wire" or tugger line vertically upwards or downwards through its hydraulic-pneumatic lifting controls provide the vertical displacement/movement capability during installation. The padeye separation X is set/adjusted before the procedure is started. Once the gooseneck connector padeye is connected to the tugger line and suspended in the moon pool, only a vertical adjustment can be made through the tugger controls. If it is the first time the system is installed on a particular rig with a specific hose type/length, it may be the case a further horizontal adjustment may be required during the first installation procedure, which would require the gooseneck connector to be laid down again so the padeye separation X can be adjusted. However, once this first rig up is completed, there should be no more adjustments required with X for this specific rig setup and hose type/length.

Referring again to FIGS. 1 and 2, these show that the hose connector assembly 10 is also provided with an alignment formation 64 which is mounted over and around the hose connector tube 18. The alignment formation provides a guide which, when a gooseneck 22 is lowered towards the hose coupling assembly 10, engages with the gooseneck 22 to guide it into position so that the gooseneck 22 can be dropped down into sealing engagement with the hose coupling assembly 10. To achieve this, in this example, the alignment formation 64 has surfaces which extend generally parallel to the longitudinal axis of the hose connector tube 18, to partially enclose the hose connector tube 18. These surfaces form an open front large enough for a gooseneck connector 22 to pass through, and converge such that the cross-sectional area enclosed by the surfaces generally parallel to the longitudinal axis of the hose connector tube 18 decreases from the open front to the back.

Figure 11A:
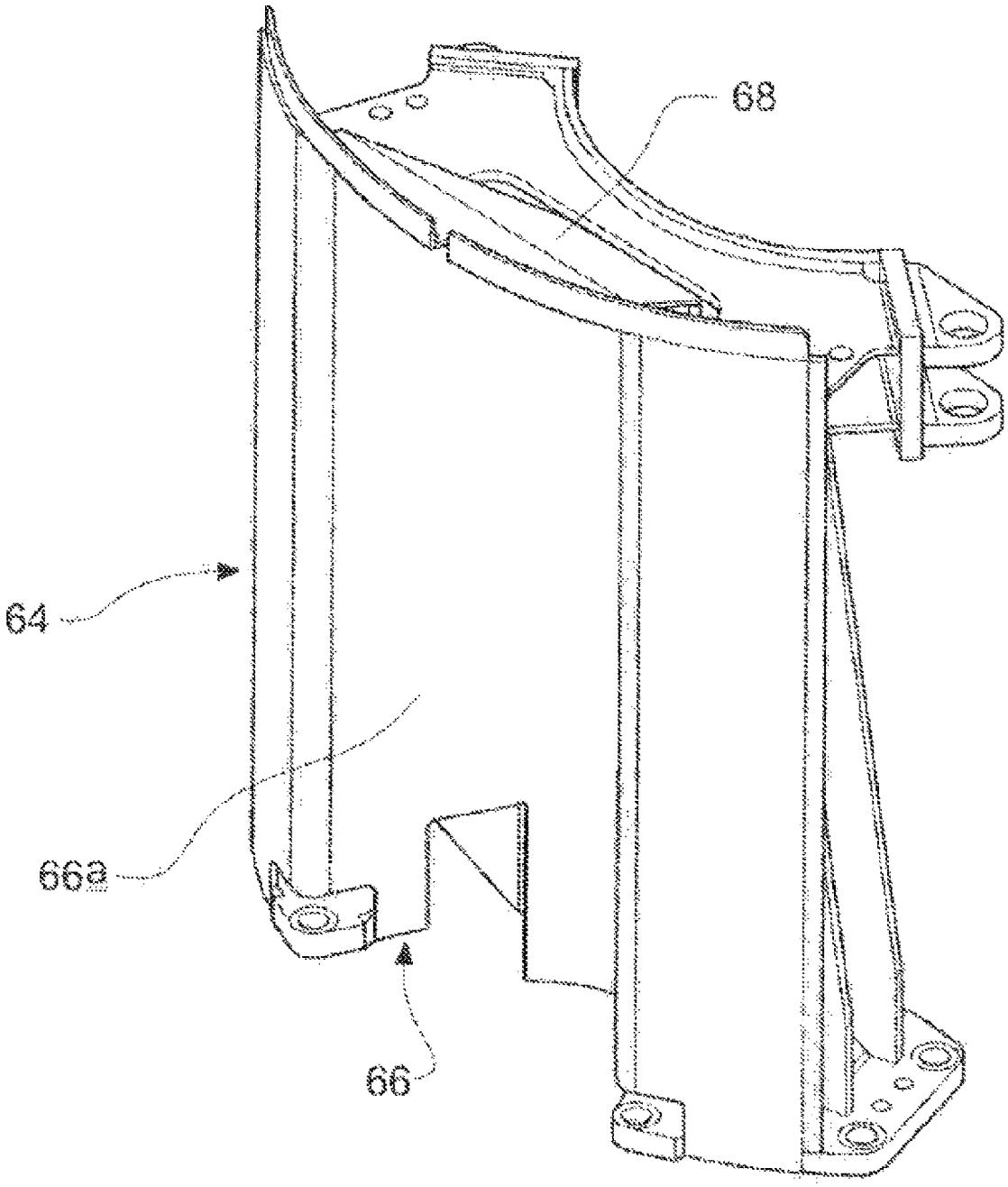
FIGS. 11*a* & 11*b* show perspective illustrations of the alignment formation of the hose connector shown in FIGS. 1 and 2.
Figure 11B:
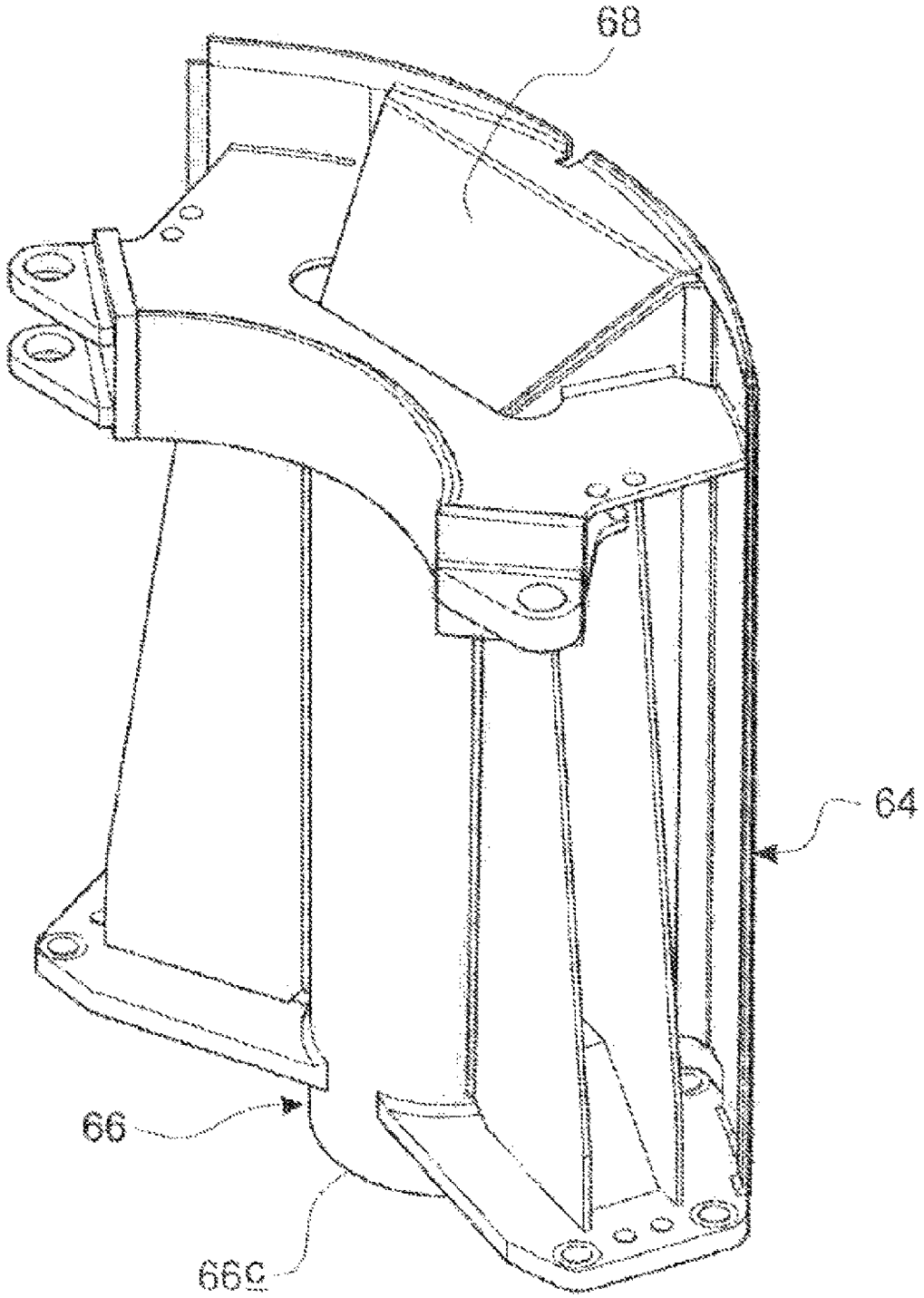
Figure 12:
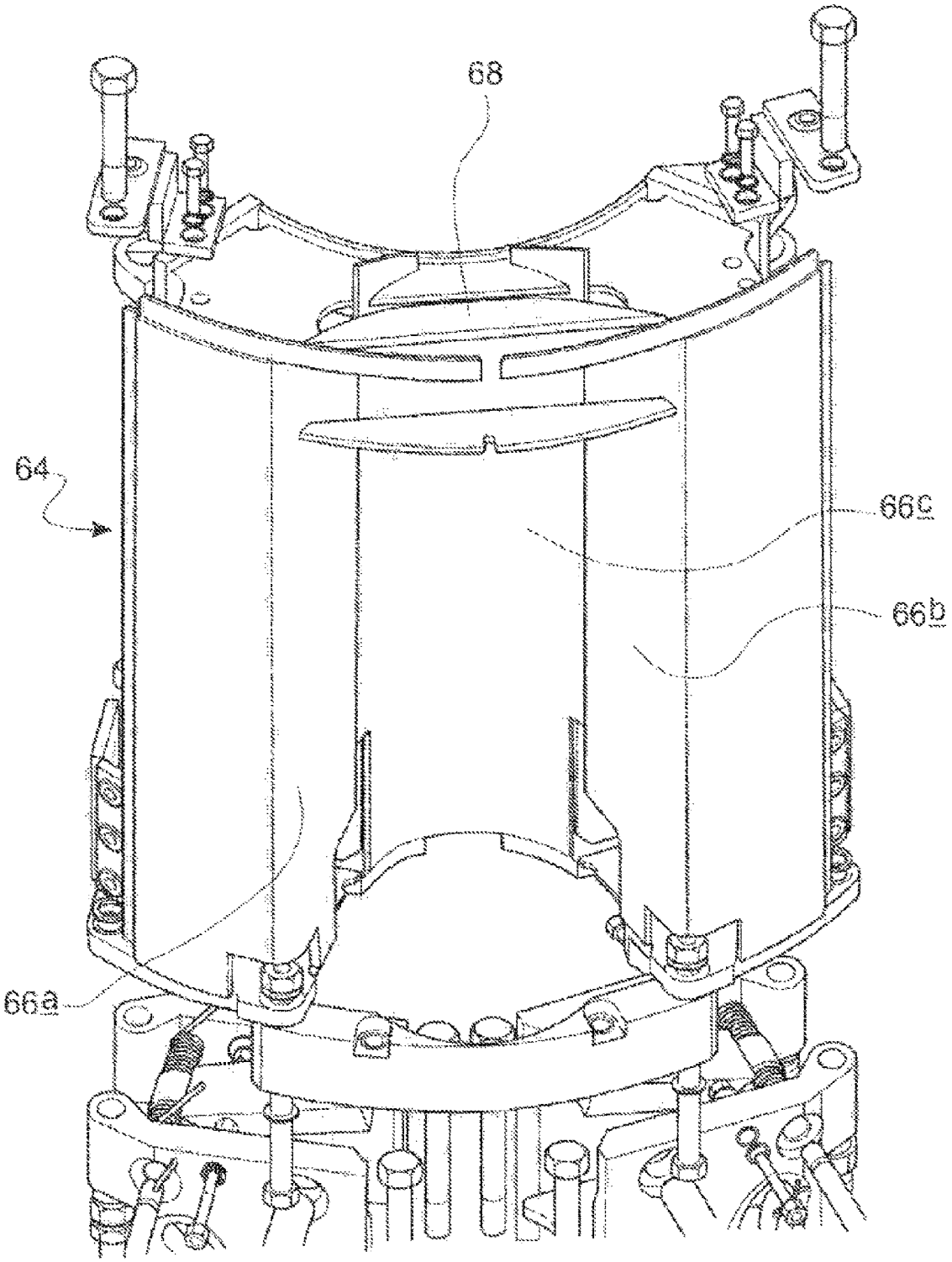
FIG. 12 shows an explode perspective illustration of the alignment formation of the hose connector shown in FIGS. 1 and 2.

One embodiment of alignment formation is shown in more detail in FIGS. 11*a*, 11*b*, and FIG. 12, and comprises a sidewall 66 and top part 68. The side wall 66 comprises a plate bent about an axis generally parallel to the longitudinal axis of the hose connector tube 18, to form two substantially flat portions 66*a*, 66*b* which are inclined at an angle of between 45° and 135° to one another (preferably around 90°), joined by a curved intermediate portion 66*c*. The hose connector tube 18 is located between the two substantially flat portions 66*a*, 66*b*, and adjacent the intermediate portion 66*c*. The side wall 66 thus forms a wide open front to ensure that it is not too difficult for an operator to lower the gooseneck connector 22 into the alignment formation, whilst converging on the hose connector tube 18 to guide the gooseneck connector 22 into vertical alignment with the hose connector tube 18.

The top part 68 extends between the flat portions 66*a*, 66*b* of the side wall 66. It is located above the hose connector tube 18 so that the longitudinal axis of the hose connector tube 18 passes through the top part 68, and is inclined at an angle of less than 90° to this longitudinal axis so that it slopes to be closer to the hose connector tube 18 moving towards the intermediate portion 66*c* of the side wall 66. This may assist in guiding the gooseneck connector 22 down onto the hose connector tube 18.

Advantageously, the depth of the top part 68 is set such that when the mounting part 58 of the gooseneck connector 22 engages with the top part 68 as the gooseneck connector 22 is lowered towards the hose connector tube 18, the second portion 22*b* of the gooseneck connector 22 is in line with the hose connector tube 18 and not too close to the intermediate portion 66*c* of the side plate 66. In other words, so that engagement of the mounting part 58 of the gooseneck connector 22 with the top part 68 of the alignment formation 64 prevents the gooseneck connector 22 from being inserted too far into the alignment formation 64.

When the gooseneck connector 22 is located on the hose connector tube 18, it will be appreciated that, if the hose 20 is not in line with the gooseneck connector 22 (i.e. extending in generally the same plane as the bent tube forming the gooseneck connector 22), the hose 20 will exert a twisting force on the gooseneck connector 22 as it is forced to bend. The hoses used in the applications described above can be extremely long and heavy, and, as a result, the shear stress in the gooseneck connector 22 induced by a misaligned hose 20 can be significant. Moreover, the twisting force required to bend the hose 20 out of alignment can make it very difficult for an operator to connect the gooseneck connector 22 to the hose coupling assembly 10. To reduce the likelihood or extent of such misalignment, in one embodiment of the invention, the gooseneck connector 22 and hose coupling assembly 10 are configured such that the angular orientation of the gooseneck connector 22 about the longitudinal axis of the hose connector tube 18 may be varied.

In this embodiment, the gooseneck connector 22 and hose connector tube 18 are both circular in transverse cross-section. As such, the gooseneck connector 22 may be mounted on the hose connector tube 18 at any relative angular orientation. Means are provided, however, to substantially prevent rotation of the gooseneck connector 22 on the hose connector tube 18 once it is installed at the desired angle.

Figure 13A:
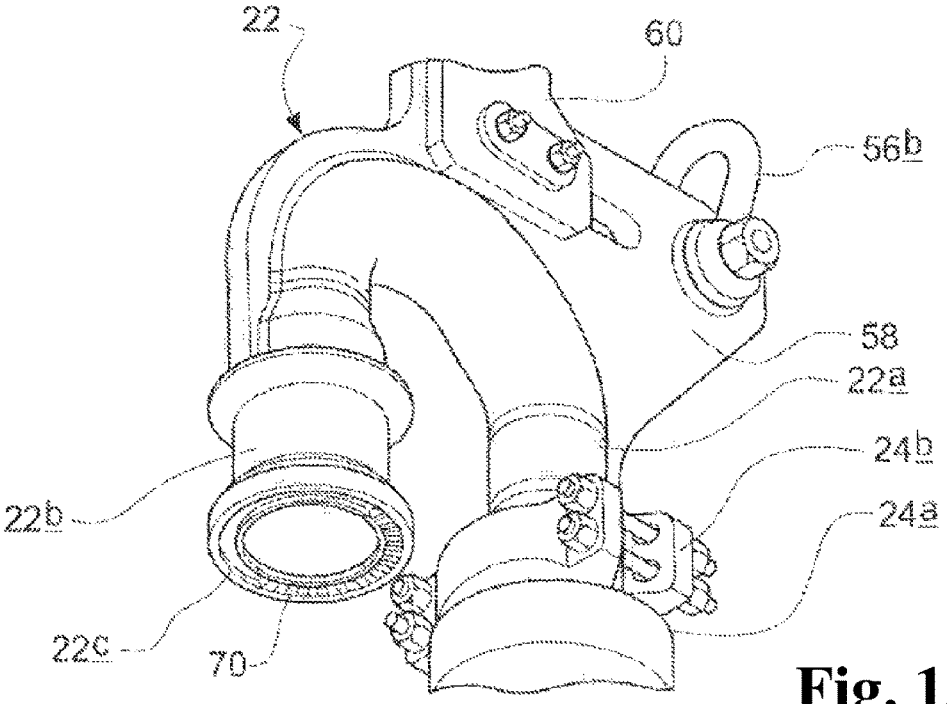
FIG. 13*a* shows a perspective view from underneath of the gooseneck connector shown in FIG. 3.
Figure 13B:
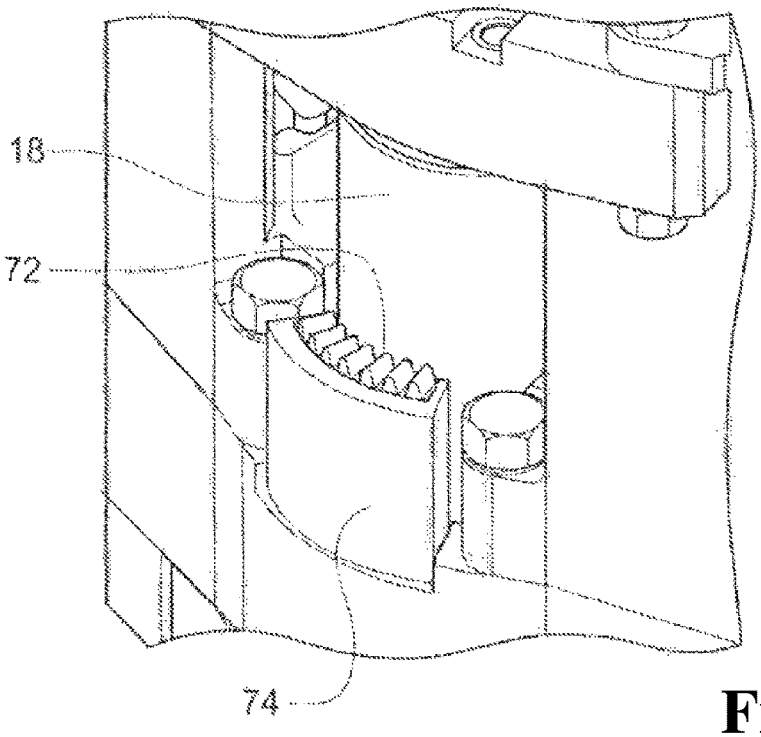
FIG. 13*b* shows a detailed perspective view of the teeth, teeth support part and hose connector tube of the hose connector illustrated in FIGS. 1 and 2.
Figure 14:
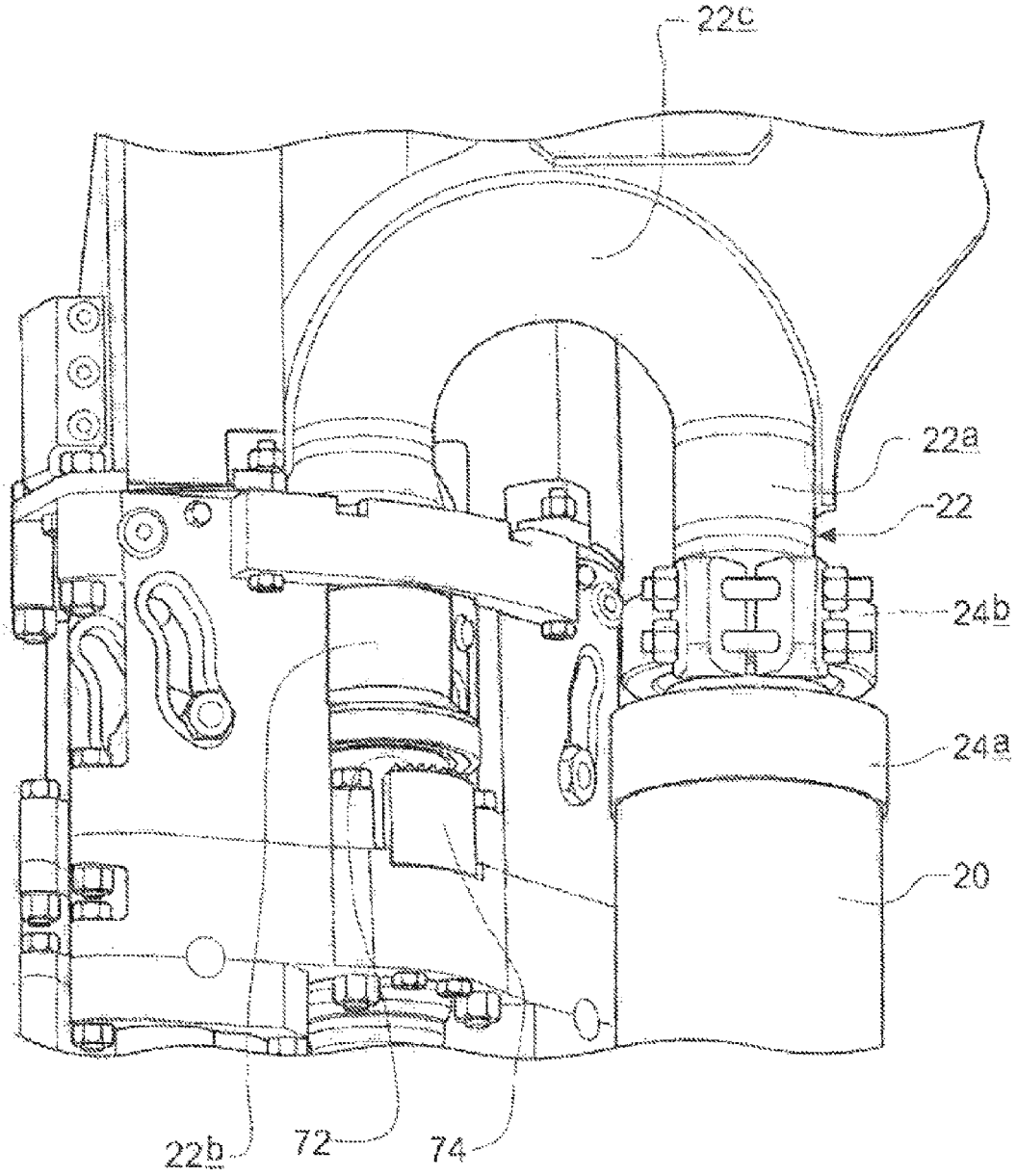
FIG. 14 shows a detailed perspective illustration of the gooseneck connector and a portion of hose connector of FIGS. 1, 2 and 3, with the gooseneck connector engaged with the hose connector.

In this example, this is achieved by the use of a meshing teeth arrangement, as illustrated in FIGS. 13*a*, 13*b* and 14. Referring first to FIG. 13*a*, the end face 22*c* of the second portion 22*b* of the gooseneck connector 22 is provided with a line of teeth 70 which extend along a portion of the circumference of a circle centered about the longitudinal axis of the second portion 22*b* of the gooseneck connector 22. In this example, the teeth 70 extend around approximately half the circle. Corresponding teeth 72 are provided on the hose coupling assembly 10, mounted on a support part 74 which extends around a portion of the outer circumference of the hose connector tube 18, as illustrated in FIG. 13*b*. Both sets of teeth 70, 72 are positioned such that they engage when the gooseneck connector 22 is mounted on the hose connector tube 18 as illustrated in FIG. 14. It will be appreciated that this interlocking of the teeth 70, 72 restricts rotation of the gooseneck connector 22 about the hose connector tube 18.

In this example, the teeth 70 on the gooseneck connector 22 are positioned on the side of the second portion 22*b* closest to the first portion 22*a*, and the teeth on the hose coupling assembly 10 mounted on the opposite side of the hose connector tube 18 to the intermediate portion 66*c* of the side wall 66 of the alignment formation 64. It will be appreciated, however, that this need not be the case, and they may be positioned on the opposite sides.

Interlocking of the teeth 70, 72 will not, of course, completely prevent movement of the gooseneck connector 22 relative to the hose coupling assembly 10. An additional lock is preferably provided to prevent the gooseneck connector 22 from sliding up the hose connector tube 18 until the teeth 70, 72 are no longer engaged.

In one embodiment, the lock is hydraulically actuated by means of a piston and cylinder arrangement. In this example, the hose coupling assembly 10 is provided with two such locks, but one or more than two could equally be provided. These are mounted on opposite sides of the hose coupling assembly 10, just below the hose connector tube 18.

Figure 16:
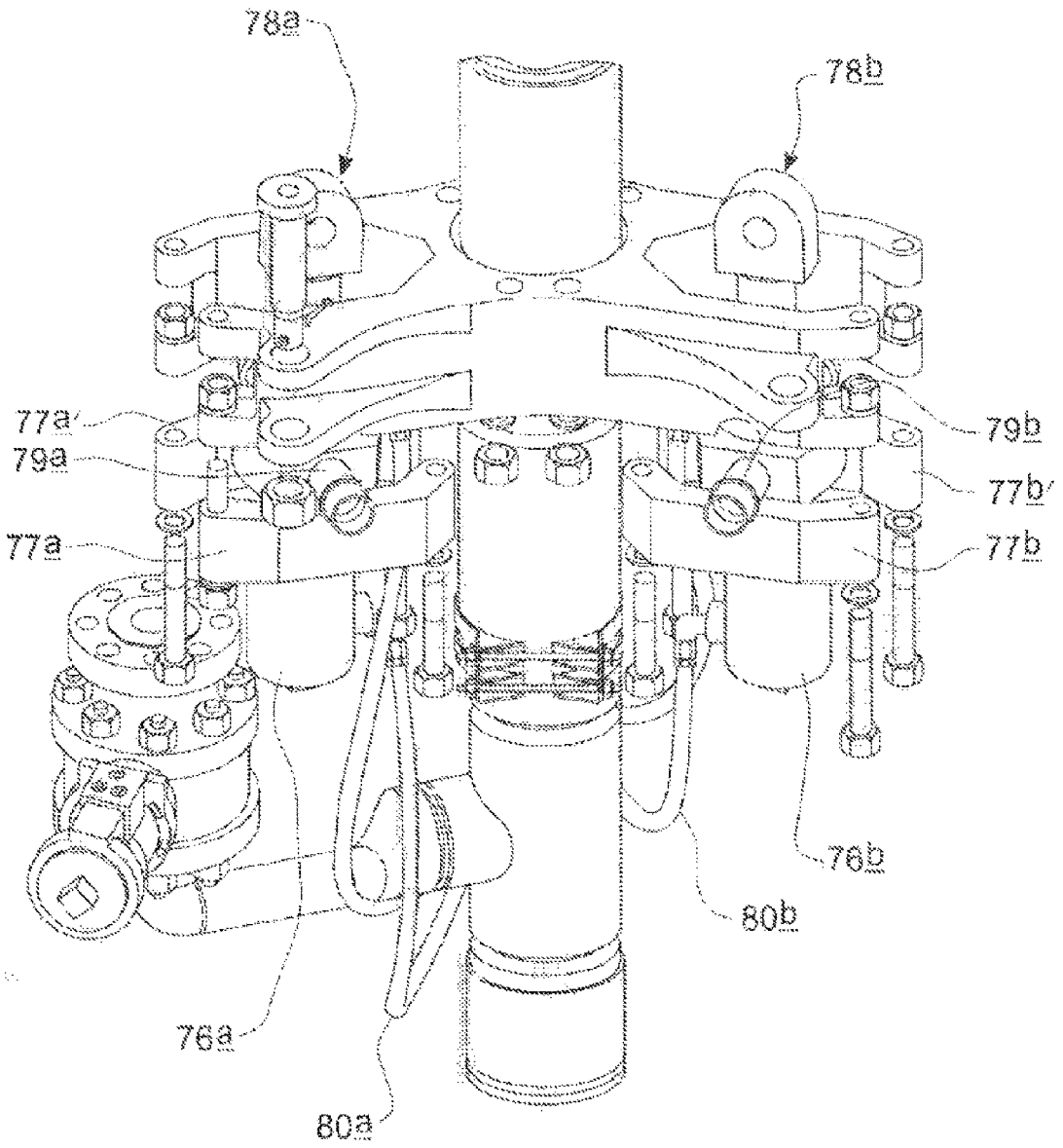
FIG. 16 shows a perspective view of the lock actuator assembly of the hose connector illustrated in FIGS. 1 and 2.

The lock actuators are best illustrated in FIG. 16, which shows the lowermost end of the cylinders 76*a*, 76*b* and the uppermost ends of the pistons 78*a*, 78*b*, along with a hydraulic line 80*a*, 80*b*, by means of which the pressurized fluid required to move the pistons 78*a*, 78*b* is supplied to the cylinders 76*a*, 76*b* from a control pod located on the flow spool. The actuators are mounted so that the pistons 78*a*, 78*b* extend upwardly from their respective cylinder 76*a*, 76*b* generally parallel to the longitudinal axis of the hose connector tube 18, although limited pivoting movement of the actuators from the vertical, towards and away from the hose connector tube 18 is permitted. In this example, this pivoting movement is achieved by having each cylinder 76*a*, 76*b* supported between two support arms 77*a*, 77*b*, by means of a pair of trunnions 79*a*, 79*a*' which extend from opposite sides of the cylinder 76*a*, 76*b*.

Figure 15:
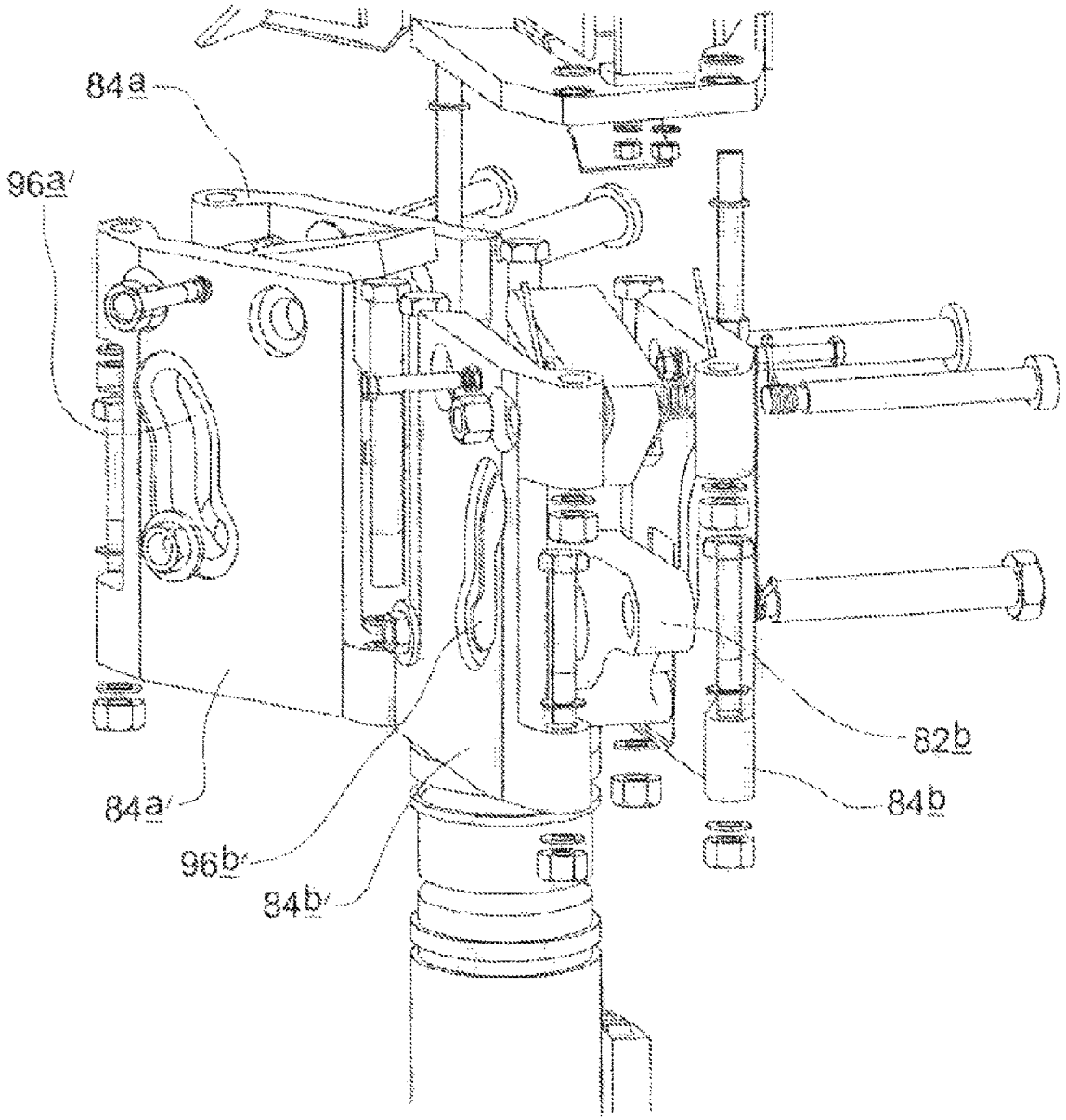
FIG. 15 shows an exploded perspective illustration of the lock assembly of the hose connector illustrated in FIGS. 1 and 2.

Each lock is also each provided with a latch part 82*a*, which is mounted above the piston 76*a* between two guide plates 84*a*, 84*a*', 84*b*, 84*b*', as illustrated in FIG. 15. The latch part 82*a* is illustrated in detail in FIG. 17*b*, and includes a pair of generally parallel arms 86, 86', each having an aperture there through, a lowermost catch 88, an uppermost catch 90, and a guide pin 92 which extends generally perpendicular to the two catches 88, 90. The free end of the piston 78*a* is located between the two arms 86, 86' of the latch part 82*a*, and the latch part 82*a* is secured to the piston 78*a* by means of a pin or bolt 94*a* which extends through the aperture in the first arm 86, through a corresponding aperture provided in the free end of the piston 78*a*, and out of the aperture in the second arm 86'. The latch part 82*a* may therefore pivot relative to the piston 78*a* about the pin/bolt 94.

Figure 17A:
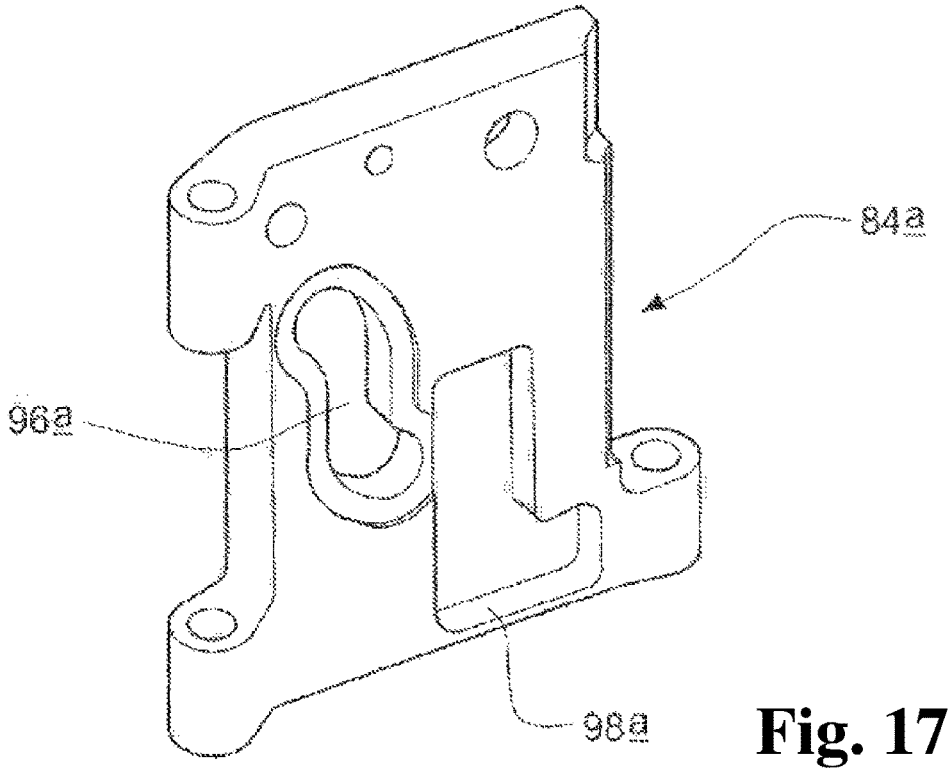
FIG. 17*a* shows a perspective illustration of one of the guide plates, and FIG. 17*b* the latch part, of the lock assembly illustrated in FIG. 15.
Figure 17B:
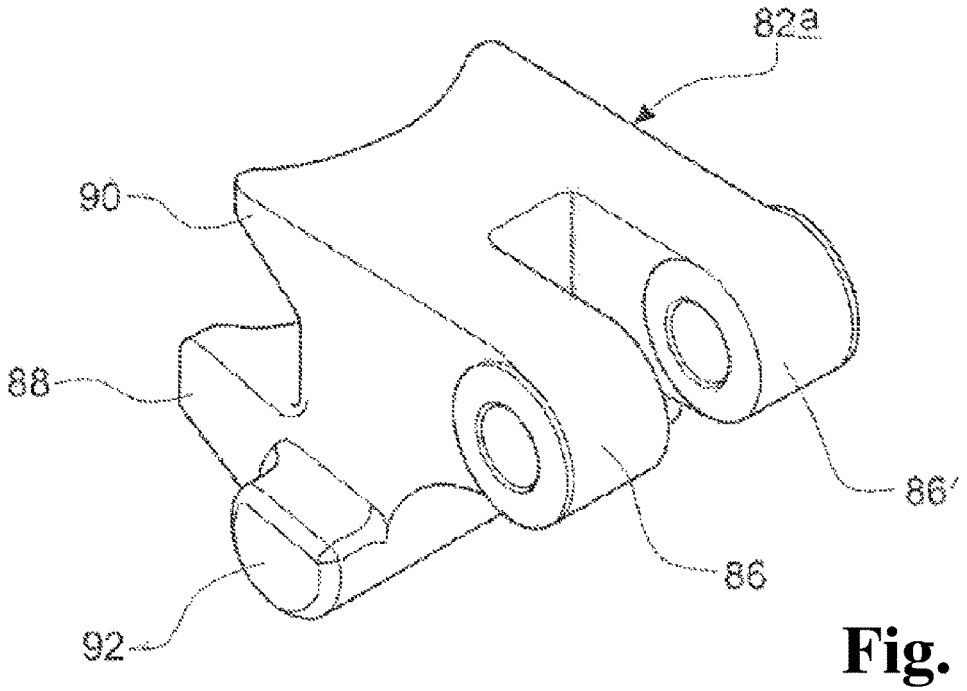

One of the guide plates 84*a* is illustrated in FIG. 17*a*. Each guide plate 84*a*, 84*a*', 84*b*, 84*b*' includes a guide slot 96*a*, 96*a*', 96*b*, 96*b*', which has a main portion, which is arranged generally parallel to the longitudinal axis of the hose connector tube 18, between two inclined end portions which extend at an angle of around 45° to the main portion, one to the right of the main portion, and the other to the left. The guide plates 84*a*, 84*a*', 84*b*, 84*b*' are each arranged so that the uppermost inclined portion of the guide slot 96*a*, 96*a*', 96*b*, 96*b*' extends away from the hose connector tube 18, whilst the lowermost inclined portion of the guide slot 96*a*, 96*a*', 96*b*, 96*b*' extends towards the hose connector tube 18. This is best seen in FIG. 1, FIG. 2, and FIGS. 18*a*, 18*b*, 18*c*, 18*d* and 18*e*.

The ends of the pin or bolt 94*a* by means of which the latch part 82*a* is secured to the piston 78*a* extend through the guide slots 96*a*, 96*a*' of the two guide plates 84*a*, 84*a*' on either side of the latch part 82*a*. This means that as the piston 78*a* moves into and out of its cylinder 76*a*, the pin/bolt 94*a* moves along the guide slots 96*a*, 96*a*', movement of the pin/bolt 94*a* into either of the inclined end portions of the guide slot 96*a*, 96*a*' causing the cylinder 76*a*, 76*b* and piston 78*a*, 78*b* to pivot about the trunnions 79*a*, 79*a*', 79*b*, 79*b* to move latch part 82*a* towards or away from the hose connector tube 18. This is best seen in FIG. 16.

The guide plates 84*a*, 84*a*', 84*b*, 84*b*' also have a generally L-shaped guide recess 98*a* which is located in the face of the guide plate 84*a*, 84*a*', 84*b*, 84*b*' adjacent to the latch part 82*a*. The guide pin 92 extends into the guide recess 98*a* so that the edges of the recess confine the guide pin 92 to movement within the guide recess 98*a* only. The effect of this on movement of the latch part 82*a* as the piston 78*a*, 78*b* moves into and out of its cylinder 76*a*, 76*b* is shown in FIGS. 18*a*, 18*b*, 18*c*, 18*d* & 18*e*.

Figure 18A:
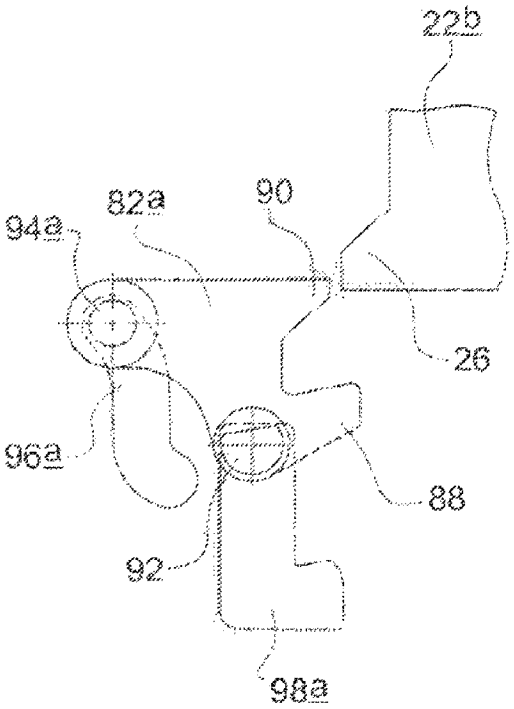
FIGS. 18*a*, 18*b*, 18*c*, 18*d* and 18*e* schematically show the relative positions of the latch part, guide plate and gooseneck connector during locking and unlocking of the lock assembly.

During the mounting of the gooseneck connector 22 on the hose connector tube 18, pressurized fluid is supplied to the cylinders 76*a*, 76*b* so the pistons 78*a*, 78*b* are extended out of their cylinder 76*a*, 76*b*. The pin/bolt 94*a* lies at the uppermost end of the guide slot 96*a* and the guide pin 92 is located at an uppermost end of the guide recess 98*a*. The movement of the pin/bolt 94*a* along the uppermost inclined portion of the guide slot 96*a* away from the hose connector tube 18 causes the latch part 82*a* to tip back so that the uppermost catch 90 is further from the hose connector tube 18 than the lowermost catch 88. The latch part 82*a* is positioned relative to the hose tube connector 18 such that as the second portion 22*b* of the gooseneck connector 22 is lowered onto the hose connector tube 18, the locking flange 26 can pass the uppermost catch 90, and come to rest on the lowermost catch 88 of the latch part 82*a*. This is illustrated in FIG. 18*a*.

Figure 18B:
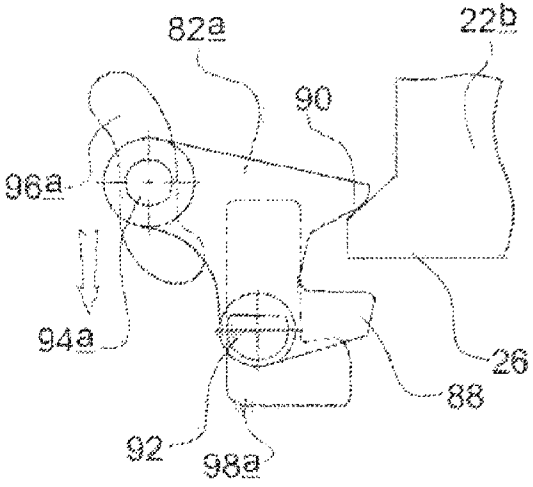

Once the gooseneck connector 22 is in the desired orientation relative to the hose connector tube 18, it is locked in place by the release of pressurized fluid from the cylinders 76*a*, 76*b*. The pin/bolt 94*a* moves down the guide slot 96*a*, and the guide pin 92 moves down the vertical portion of the guide recess 98*a*. The movement of the pin/bolt 94*a* down the uppermost inclined portion of the guide slot 96*a* and into the intermediate portion (towards the hose connector tube 18) causes the latch part 82*a* to tip forwards so that the uppermost catch 90 moves towards the hose connector tube 18 until is it generally the same distance from the hose connector tube 18 as the lowermost catch 88. As the pin/bolt 94*a* moves down the intermediate portion of the guide slot 96*a*, the uppermost catch 90 pushes down on the locking flange 26, moving the second portion 22*b* of the gooseneck connector 22 towards the teeth 72. This is illustrated in FIG. 18*b*.

Figure 18C:
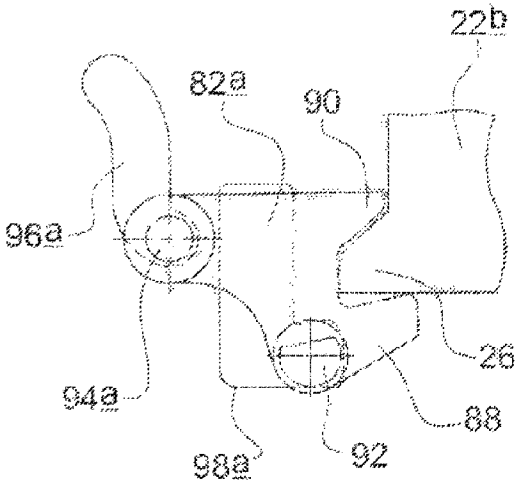

Finally, the pin/bolt 94*a* enters the lowermost inclined portion of the guide slot 96*a* as the teeth 70 of the gooseneck connector 22 engage with the teeth 72 on the hose coupling assembly 10. The resulting movement of the pin/bolt 94*a* towards the hose connector tube 18 causes the guide pin 92 to move generally horizontally along the bottom of the guide recess 98*a* also towards the hose connector tube 18. This, in turn, causes the latch part 82*a* to tip backwards so that the lowermost catch 88 moves towards the hose connector tube 18, whilst the uppermost catch 90 moves towards it and engages with an uppermost surface of the locking flange 26. This is illustrated in FIG. 18*c*. The locking flange 26 is therefore captured between the uppermost catch 90 and lowermost catch 88 of the locking part 82*a*, and movement of the gooseneck connector 22 relative to the hose coupling assembly 10 can only (within reason) be achieved by the lifting of the piston 78*a*, 78*b* in its cylinder 76*a*, 76*b*.

Figure 18E:
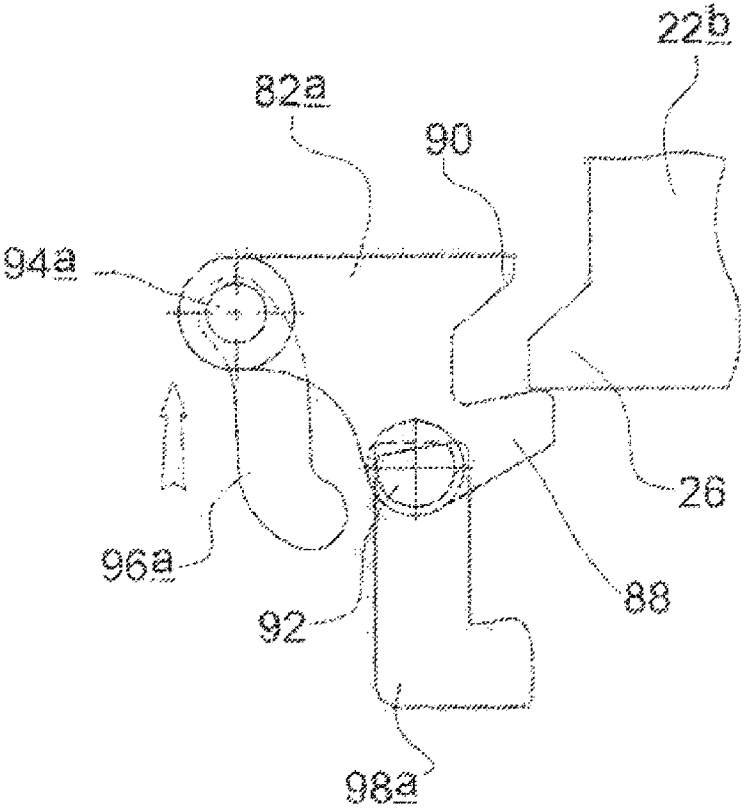
Figure 18D:
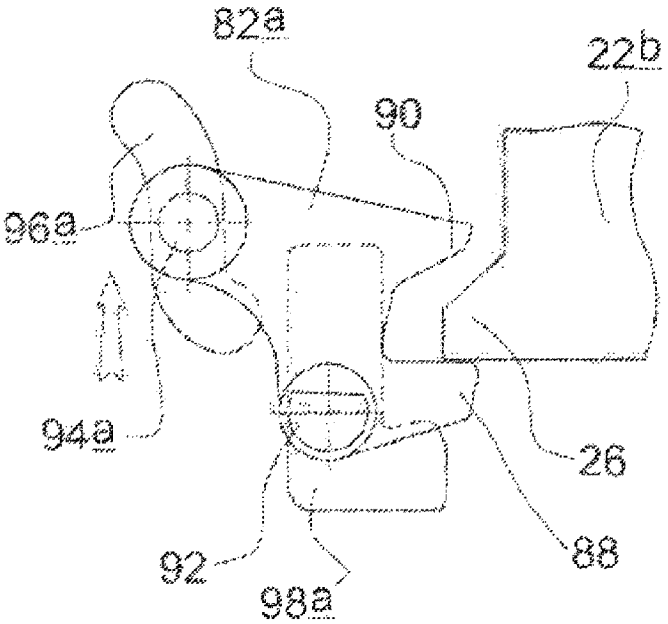

When it is desired to release the gooseneck connector 22 from the hose coupling assembly 10, pressurized fluid is supplied to the cylinders 76*a*, 76*b*. The pin/bolt 94*a* moves up the guide slot 96*a*, and the guide pin 92 moves along and up the guide recess 98*a*. The movement of the pin/bolt 94*a* out of the lowermost inclined portion of the guide slot 96*a* and into the intermediate portion (away from the hose connector tube 18) and the movement of the guide pin 92 horizontally along the bottom of the guide recess 98*a* also away from the hose connector tube 18, causes the latch part 82*a* to tip backwards so that the uppermost catch 90 moves away from the hose connector tube 18, and the lowermost catch 88 moves towards it. As the pin/bolt 94*a* moves up the intermediate portion of the guide slot 96*a*, the lowermost catch 88 pushes up on the locking flange 26, moving the second portion 22*b* of the gooseneck connector 22 away from the teeth 72. This is illustrated in FIG. 18*d*.

The final upward movement of the pin/bolt 94*a* along the uppermost inclined portion of the guide slot 96*a* away from the hose connector tube 18 again causes the latch part 82*a* to tip back so that the uppermost catch 90 is further from the hose connector tube 18 than the lowermost catch 88. The locking flange 26 can then pass the uppermost catch 90, and be removed from the hose connector tube 18. This is illustrated in FIG. 18*e*.

The use of a fluid pressure operated actuator to push the gooseneck connector 22 up the hose connector tube 18 may be particularly useful as marine growth on the assembly can mean that significant force may be required to separate the second portion 22*b* of the gooseneck connector 22 from the hose connector tube 18. The freedom of the gooseneck connector 22 to pivot about the hose connector tube 18 can also assist in the breakage of marine growth.

Advantageously, where the hose coupling assembly 10 is to be mounted on a flow spool 40 as illustrated in FIG. 5, it is located at a lower end of the flow spool 40 so that there is sufficient clearance between the hose coupling assembly 10 and the slip joint 32 to allow for simultaneous connection of the hose 20 to the hose coupling assembly 10 and connection of the slip joint 32 at the top of the riser 28. The opportunity to perform these procedures in parallel can reduce rig up time over the moon pool. The hose connections can be made up below the rotary table 50 whilst a top cross over flange is suspended by a spider on the rig floor 54. This allows the base of the slip joint 32 to be connected to the top of the rotating pressure containment apparatus 38 at the same time as the hose connections are being made. If the hose coupling assembly 10 is too high up the flow spool 40, there may not be enough clearance to lower the gooseneck connector 22 onto the hose connector tube 18 with the slip joint 32 in place. In this case, it would be necessary to wait until all the hose connections are made before installing the slip joint 32.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the invention in diverse forms thereof.

What is claimed is:

1. A connector assembly for connecting a hose to a tubular element, the connector assembly comprising:

a tubular housing comprising a main passage which extends substantially parallel to a longitudinal axis of the tubular housing and which is enclosed in the tubular housing, and a side passage which extends through the tubular housing from an exterior of the tubular housing to the main passage so as to form a continuous passage together therewith, the side passage further extending through a connector tube which is mounted on the exterior of the tubular housing;

a hose connector configured to be secured to an end of the hose and to engage with the connector tube for connecting the hose to the tubular element, the hose connector comprising a pipe portion which is configured to mate with the connector tube so that an interior of the hose is connected to the side passage; and a latch operable to urge the connector tube and the pipe portion into engagement and to prevent a separation of the connector tube and the pipe portion when the connector tube and the pipe portion are mated to connect the interior of the hose with the side passage, wherein the latch is movable between an open position in which the connector tube and pipe portion are separable, and a closed position in which the latch prevents the separation of the connector tube and pipe portion, the latch being configured so that, on a movement of the latch from the closed position to the open position, the latch pushes the connector tube and pipe portion apart.

2. The connector assembly as recited in claim 1, wherein the latch is hydraulically operated.

3. The connector assembly as recited in claim 1, wherein the pipe portion is adapted to be placed over the connector tube so that the connector tube extends into the pipe portion when the two parts mate to connect the interior of the hose with the side passage.

4. The connector assembly as recited in claim 3, wherein the pipe portion is provided with a radially outwardly extending flange at its free end, and the latch is provided with a lowermost catch and an uppermost catch and is configured so that when the latch is in the closed position, an uppermost catch bears down on the flange to prevent the pipe portion being lifted off the connector tube, and as the latch is moved to the open position, a lowermost catch pushes the flange up to commence lifting the pipe portion off the connector tube.

5. The connector assembly as recited in claim 1, wherein the tubular housing is configured to be secured to a drilling riser.

6. The connector assembly as recited in claim 1, wherein the latch is pivotally mounted relative to the connector tube.

7. The connector assembly as recited in claim 1, wherein the latch includes a first arm and a second arm which are configured to be substantially parallel, each of the first arm and the second arm comprising an aperture therethrough.

8. The connector assembly as recited in claim 7, wherein the latch is secured to a piston by a pin or a bolt which extends through the aperture in the first arm, through a corresponding aperture in a free end of the piston, and through the aperture in the second arm, so that the latch can pivot relative to the piston about the pin or about the bolt.

9. The connector assembly as recited in claim 8, wherein the piston is mounted in a cylinder which extends substantially parallel to a longitudinal axis of the connector tube so that a limited pivoting movement of the piston and the cylinder towards and away from the connector tube is permitted.

10. The connector assembly as recited in claim 4, wherein the latch further includes a guide pin which extends substantially perpendicular to the two catches.

11. The connector assembly as recited in claim 8, further comprising a guide plate mounted on the connector tube, the guide plate including a guide slot into which an end of the pin or the bolt extends.

12. The connector assembly as recited in claim 10, wherein the guide plate further includes a substantially L-shaped guide recess which is located in the face of the guide plate adjacent the latch, the guide pin extending into the guide recess so that the edges of the recess confine the guide pin to a movement only within the guide recess.

13. The connector assembly as recited in claim 10, wherein the connector assembly includes two guide plates, and the latch includes two guide pins each of which extends substantially perpendicular to the catches in opposite directions, the latch being mounted between the guide plates so that the each end of the pin or the bolt extends into the guide slot of one of the guide plates, and each guide pin extends into a substantially L-shaped guide recess of one of the guide plates.

14. A connector assembly for connecting a hose to a tubular element, the connector assembly comprising:

a tubular housing comprising a main passage which extends substantially parallel to a longitudinal axis of the tubular housing and which is enclosed in the tubular housing, and a side passage which extends through the tubular housing from an exterior of the tubular housing to the main passage so as to form a continuous passage together therewith, the side passage further extending through a connector tube which is mounted on the exterior of the tubular housing; and a hose connector adapted to be secured to an end of the hose and to engage with the connector tube for connecting the hose to the tubular element, the hose connector comprising a pipe portion which is adapted to mate with the connector tube so that the interior of the hose is connected to the side passage, wherein, the connector tube and pipe portion of the hose connector are both circular in a transverse cross-section and are both provided with a plurality of teeth which are configured to be engaged to assist in retaining the connector tube and pipe portion in a desired angular orientation relative to one another, one of the connector tube and the pipe portion is adapted to extend into the other of the pipe portion or connector tube when the two parts mate to connect the interior of the hose with the side passage, and the one of the connector tube or pipe portion which is located outside the other when the two mate to connect the interior of the hose with the side passage is provided with a radially outwardly extending flange at its free end, the teeth being provided in a surface of the flange, the surface in which the teeth are provided being configured to extend so as to be substantially perpendicular to a longitudinal axis of the connector tube.

15. The connector assembly as recited in claim 14, wherein the pipe portion is adapted to be placed over the connector tube so that the connector tube extends into the pipe portion when the two parts mate to connect the interior of the hose with the side passage.

16. The connector assembly as recited in claim 14, wherein the assembly is further provided with a latch which is operable to urge the teeth of the connector tube and pipe portion into engagement and to prevent separation of the connector tube and pipe portion when the two are mated to connect the interior of the hose with the side passage.

17. The connector assembly as recited in claim 16 wherein the latch is hydraulically operated.

18. The connector assembly as recited in claim 16, wherein the latch is movable between an open position in which the connector tube and pipe portion are separable, and a closed position in which the latch prevents separation of the connector tube and pipe portion, and configured such that, on movement of the latch from the closed position to the open position, the latch pushes the connector tube and pipe portion apart.

19. The connector assembly as recited in claim 16, wherein the tubular housing is adapted to be secured to a drilling riser.

* * * * *